US008728256B2

(12) United States Patent
Che et al.

(10) Patent No.: US 8,728,256 B2
(45) Date of Patent: May 20, 2014

(54) MULTI-ELEMENT HEAT-RESISTANT ALUMINUM ALLOY MATERIAL WITH HIGH STRENGTH AND PREPARATION METHOD THEREOF

(75) Inventors: Yun Che, Guiyang (CN); Zhongke Zhang, Guiyang (CN); Sanquan Men, Guiyang (CN); Xinmeng Chen, Guiyang (CN); Guangyou Xu, Guiyang (CN); Xiang Li, Guiyang (CN)

(73) Assignee: Guizhou Hua-Ke Aluminum-Materials Engineering Research Co., Ltd., Guiyang, Guizhou (CN)

( * ) Notice: Subject to any disclaimer, the term of this patent is extended or adjusted under 35 U.S.C. 154(b) by 0 days.

(21) Appl. No.: 13/392,868

(22) PCT Filed: Aug. 4, 2010

(86) PCT No.: PCT/CN2010/075711

§ 371 (c)(1),
(2), (4) Date: Feb. 27, 2012

(87) PCT Pub. No.: WO2011/023059

PCT Pub. Date: Mar. 3, 2011

(65) Prior Publication Data

US 2012/0152414 A1 Jun. 21, 2012

(30) Foreign Application Priority Data

| | | |
|---|---|---|
| Aug. 27, 2009 | (CN) | 2009 1 0306166 |
| Aug. 27, 2009 | (CN) | 2009 1 0306176 |
| Aug. 27, 2009 | (CN) | 2009 1 0306182 |
| Sep. 9, 2009 | (CN) | 2009 1 0306784 |
| Sep. 17, 2009 | (CN) | 2009 1 0307169 |
| Sep. 17, 2009 | (CN) | 2009 1 0307176 |
| Sep. 18, 2009 | (CN) | 2009 1 0307210 |
| Sep. 23, 2009 | (CN) | 2009 1 0307496 |

(51) Int. Cl.
*C22F 1/057* (2006.01)
*C22C 21/12* (2006.01)

(52) U.S. Cl.
USPC ..... 148/549; 148/438

(58) Field of Classification Search
USPC ..... 148/549
See application file for complete search history.

(56) References Cited

FOREIGN PATENT DOCUMENTS

| | | | | |
|---|---|---|---|---|
| CN | 101319287 | A | 12/2008 | |
| CN | 101363092 | A | 2/2009 | |
| CN | 101363093 | A | 2/2009 | |
| CN | 101363094 | A | 2/2009 | |
| EP | 0 079 749 | A2 | 5/1983 | |
| GB | 709527 | * | 5/1954 | ..... C22C 21/12 |
| SU | 1 746 737 | A1 | 11/1994 | |

OTHER PUBLICATIONS

PCT International Search Report for PCT Counterpart Application No. PCT/CN2010/075711 containing Communication relating to the Results of the International Search Report, 10 pgs., (Nov. 18, 2010).

* cited by examiner

*Primary Examiner* — Keith Walker
*Assistant Examiner* — Alexander Polyansky
(74) *Attorney, Agent, or Firm* — Blakely, Sokoloff, Taylor & Zafman LLP

(57) ABSTRACT

A heat-resistant aluminum alloy material with high strength and preparation method thereof are provided. The aluminum alloy material comprises (by weight %): Cu: 1.0~10.0, Mn: 0.05~1.5, Cd: 0.01~0.5, Ti: 0.01~0.5%, B: 0.01~0.2 or C: 0.0001~0.15, Zr: 0.01~1.0, R: 0.001~3 or ($R_1$+$R_2$): 0.001~3, RE: 0.05~5, and balance Al:, wherein, R, $R_1$, and $R_2$ include Be, Co, Cr, Li, Mo, Nb, Ni, W. The Al alloy has the advantages of narrow quasi-solid phases temperature range of alloys, low hot cracking liability during casting improved high temperature strength and high heat resistance.

2 Claims, No Drawings

MULTI-ELEMENT HEAT-RESISTANT ALUMINUM ALLOY MATERIAL WITH HIGH STRENGTH AND PREPARATION METHOD THEREOF

CROSS-REFERENCE TO RELATED APPLICATIONS

This patent application is a U.S. National Phase application under 35U.S.C. §371of International Application No. PCT/CN2010/075711, filed Aug. 4, 2010, entitled MULTI-ELEMENT HEAT-RESISTANT ALUMINUM ALLOY MATERIAL HIGH WITH HIGH STRENGTH AND PREPARATION METHOD THEREOF, which claims priority to Chinese patent application number 200910306182.4, filed Aug. 27, 2009, Chinese patent application number 200910306166.5, filed Aug. 27,2009, Chinese patent application number 200910306176.9, filed Aug. 27,2009, Chinese patent application number 200910306784.X, filed Sep. 9,2009, Chinese patent application number 200910307176.0, filed Sep. 17,2009, Chinese patent application number 200910307169.0, filed Sep. 17,2009, Chinese patent application number 200910307210.4, filed Sep. 18, 2009, and Chinese patent application number 200910307496.6, filed Sep. 23, 2009.

FIELD OF THE INVENTION

The present invention relates to an aluminum alloy material and a preparation method thereof, in particular to an aluminum alloy material comprising micro-alloying elements and rare earth elements and a preparation method thereof.

BACKGROUND OF THE INVENTION

Aluminum alloy is a metallic material emerged lately, and had not been applied industrially until the beginning of the $20^{th}$ Century. During the period of World War II, aluminum materials was mainly used to produce military aircrafts. After the war, as the demand for aluminum materials in the military industry decreased suddenly, the community of aluminum industry set about to develop aluminum alloy for civil use; therefore, the fields of application of aluminum alloy expanded from aircraft industry to all sectors of national economy such as building industry, vessel packaging industry, traffic and transport industry, electric power and electronic industry, mechanical manufacturing industry, and petrochemical industry, etc., and the aluminum alloy was gradually applied in people's daily life. Nowadays, aluminum materials is only inferior to iron and steel materials in terms of application scale and scope, and become the second major metallic material in the world.

From the aspect of manufacturing and aluminum alloy products, high-strength aluminum alloys are usually divided into wrought aluminum alloys and cast aluminum alloys; from the aspect of working temperature of the products, high-strength aluminum alloys are divided into ordinary aluminum alloys and high-temperature (or heat-resistant) aluminum alloys. Up to now, only Al—Cu based aluminum alloys can meet the demand for high temperature and high strength features. Viewed from designation series, Al—Cu based aluminum alloys comprises cast aluminum alloys and wrought aluminum alloys, both of which belong to Series 2 aluminum alloys; however, there is no publication to disclose the high-temperature aluminum alloy with high strength which has good casting properties and tend to deforming machining.

1. High-strength Cast Aluminum Alloy and Wrought Aluminum Alloys

In generally, cast aluminum alloys include AlSi based aluminum alloy, AlCu based aluminum alloy, AlMg based aluminum alloy, and AlZn based aluminum alloy, wherein, AlCu based aluminum alloy and AlZn based aluminum alloy have the highest strength, but most of them have a strength in the range of 200 MPa~300 MPa.

Only a few of designations from the AlCu based aluminum alloy have a strength higher than 400 MPa, but the cost of manufacture of them is high, since it is required of refined aluminum matrix and admixture of noble elements; AlZn based cast alloys have poor heat-resistant performance. Therefore, the scope of application of ordinary cast aluminum alloys is severely limited because these alloys have inferior obdurability when compared to wrought aluminum alloys. For important application purposes, such as load wheels for special heavy duty vehicles and aviation applications, usually wrought aluminum alloys are used, instead of cast aluminum alloys. By means of extrusion, rolling, and forging, etc., wrought aluminum alloys have reduced defects, refined crystal grains, and increased tightness, and therefore have high strength, excellent toughness, and high service performance. However, owing to the high requirement for processing equipment and molds and complex processing procedures, wrought aluminum alloys require a long production cycle and high cost. Compared with wrought aluminum alloys, cast aluminum alloys have advantages such as lower price, isotropic structure, availability of special structures, applicability for production of components with complicated shapes, and suitability for small-lot production and mass production, etc. Therefore, it is of great theoretical significance and high practical application value to develop cast aluminum alloy materials with high-obdurability and cast forming processes for replacement of some wrought aluminum alloys, so as to attain the purpose of replacing forging with cast, shortening manufacturing cycle, and reducing production cost.

In the developing process of cast aluminum alloys with high-obdurability, the A-U5GT cast aluminum alloy developed in France at the beginning of the $20^{th}$ Century takes an important place. Among typical cast aluminum alloys with high-obdurability available presently, A-U5GT has the longest history and the widest scope of application. There is no corresponding designation equivalent to it in China yet.

American Aluminum Association designation 201.0 (1986) and 206.0 (1967), which were developed on the basis of A-U5GT, have excellent mechanical properties and stress corrosion resistant property. However, since they contain 0.4%~1.0% of silver, they have a high material cost and are only applied in military field or other demanding fields, with a limited scope of application.

China has achieved remarkable achievements in the field of cast aluminum alloy with high-obdurability. In 1960s to 1970s, Beijing Aviation Material Institute successfully developed ZL205A alloy. ZL205A alloy has a complex composition, containing seven kinds of alloying elements, i.e., Cu, Mn, Zr, V, Cd, Ti, and B. ZL205A (T6) has a tensile strength of 510 MPa, which is the highest among the registered designations of cast aluminum alloy materials. ZL205A (T5) has the highest obdurability and an elongation up to 13%. However, a major defect of ZL205A is its poor casting properties and high tendency of hot cracking; in addition, it has a small scope of application due to the high cost of formulation.

The above three cast aluminum alloys with high-obdurability belong to Al—Cu base having high strength as well as high plasticity and toughness. However, their casting properties are not so satisfactory, represented by high tendency of hot cracking, poor flowability, and poor feeding property. Moreover, Al—Cu based alloys have poor corrosive resistance and exhibit a tendency of intercrystalline corrosion. The finished product rate of the Al—Cu based alloys in the casting process is very low.

In the four published patent applications Nos. 200810302670.3, 200810302668.6, 200810302669.0, and 200810302671.8, titled as "High-Strength Cast Aluminum Alloy Material", a high-strength cast aluminum alloy material composed of Cu, Mn, Ti, Cr, Cd, Zr, B, and rare earth elements was disclosed. The aluminum alloy material has a tensile strength up to 440 MPa and an elongation greater than 6%; however, in actual application of the high-strength cast aluminum alloy material, the problems of high tendency to hot cracking and severe contradiction between alloy strength and castability are not solved, mainly because of the wide temperature range of quasi-solid phase within the composition range of major elements Cu and Mn of the alloy, which provides sufficient conditions for growth of anisotropic dendritic crystals during solidification in the casting process, and therefore results in high internal shrinkage stress in the late stage of solidification and leaves high tendency to hot cracking during shrinkage.

Up to now, there are more than 70 kinds of formally registered designations of wrought aluminum alloy in Series 2XXX, and most of them are registered in USA, wherein, only 14 designations (i.e., 2001, 2004, 2011, 2011A, 2111, 2219, 2319, 2419, 2519, 2021, 2A16, 2A17, 2A20, and 2B16) are high-copper aluminum alloys with a copper content of higher than 5%, and only 4 kinds of designations (i.e., 2A16, 2A17, 2A20, and 2B16) have a copper content of higher than 6%. These wrought aluminum alloys have high contents of Si, Mg, and Zn, etc. in their formulations, but there is no micro-alloying elements such as rare earth (RE) elements. Therefore, their formulations are much different from those of the Series 2 cast aluminum alloys, which reflects the difference in production process and deep processing process between the two types of aluminum alloys.

2. High-Temperature Aluminum Alloys

High-temperature alloys are also referred to heat-resistant alloys with high-strength, thermal-strength alloys, or super alloys, which is an important metallic material developed as the emergence of the aviation turbine engines in the 1940s. They can withstand high service load for a long period under the condition of high temperature oxidative atmosphere and exhaust corrosion, are mainly applied for hot-side components of gas turbine, and is an important structural material in aerospace and aviation, ship, power generation, petrochemical, and transportation industries. Wherein, some alloys can also be applied as materials in arthrosteopedic surgery and dental surgery in biological engineering field.

Common high-temperature alloys include nickel-based, iron-based, and cobalt-based alloys, which can service in high-temperature environments at 600~1100° C.; whereas, heat-resistant aluminum alloys were developed in the cold war period. Heat-resistant aluminum alloys with high-strength are suitable to bear high service load in hot environments up to a temperature of 400° C. for a long period, and are more and more applied in aerospace and aviation, and heavy-duty mechanical industries, etc. Strong-power components subjected to high-temperature and high-pressure can be cast from heat-resistant aluminum alloys with high-strength, except for the components that directly contact with high temperature fuel gas in aviation turbine engines and gas turbines, etc.

Owing to the fact that aluminum alloys are easy to process, as the improving of the technical level of processing, wrought aluminum alloys are used to replace cast aluminum alloys in more and more applications, provided that the requirement for strength is met. Therefore, heat-resistant aluminum alloys with high-strength are divided into cast alloys and wrought alloys.

Usually, heat-resistant alloys with high-strength contain several or even tens of alloying elements. The admixed elements perform the functions such as solid solution strengthening, dispersion strengthening, grain boundary strengthening, and surface stabilization in the alloy, to enable the alloy to maintain high mechanical properties and high environmental performance at high temperature.

Considerations in Selection of High-Temperature Alloy for Casting:

(1) Normal, maximum, and minimum working temperatures and temperature fluctuation rate of the cast product;

(2) Temperature difference range of the cast product and expansion property of the alloy;

(3) Characteristics of the load on the cast product, and loading, supporting, and external constraints;

(4) Requirement for service life of cast product, allowable amount of deformation, nature of working environment, shaping method, and factors related to cost, etc.

At present, in the Chinese national standards, aluminum alloy materials for casting of high temperature parts only include designations of A201.0, ZL206, ZL207, ZL208, and 206.0, including Al—Cu—Mn based alloys and Al-RE based alloys; wherein, most of Al—Cu—Mn based alloys employ high-purity aluminum ingots as the alloy material, and therefore have a high cost; whereas the Al-RE based alloys have a relatively poor mechanical properties at room temperature. Moreover, most heat-resistant aluminum alloys with high-strength available today have drawbacks such as low strength at high temperature (instantaneous tensile strength less than 200 MPa and long-term strength less than 100 MPa at a temperature of 250° C. or higher), high formulation cost, poor casting properties, low casting yield rate, and poor reuse of waste scrap and slag, etc., resulting in poor quality of cast products, high cost, and long slag treatment cycle, etc. Furthermore, most heat-resistant aluminum alloys declared for patent application in recent years contain noble elements in their formulations, and have unsatisfactory casting properties, can not meet the technological progress in aviation industry in terms of quality, and are unsuitable for industrial production and application.

Few heat-resistant wrought aluminum alloys with high-strength that can be widely applied in the development of national economy and modernization of national defense and have a splendid prospect are seen in domestic or foreign literature. Most of known Series 2XXX wrought aluminum alloys (such as 2219, 2A02, 2A04, 2A06, 2A10, 2A11, 2A12, 2A14, 2A16, 2A17, 2A50, 2A70, and 2A80, etc.) and Series 7XXX wrought aluminum alloys (such as 7A04, etc.) have a strength lower than 100 MPa at a temperature of 256° C. or higher, and the major micro-alloying elements are Si, Mg, and Zn, besides Cu and Mn. There is no report on the heat-resistant wrought aluminum alloy materials with high-strength having a strength of higher than 150 MPa at a temperature of 250° C. or higher without admixture of those elements.

In summary, the problems existing in the research of heat-resistant aluminum alloys with high-strength in China and foreign countries include: insufficient strength and durability at high temperature, instantaneous strength less than 250 MPa at a temperature of 250° C. or higher, and long-term strength less than 100 MPa at high temperature; poor processability of the material, long waste treatment cycle, high cost, and lag behind the technological progress in aviation industry, etc.

SUMMARY OF THE INVENTION

The problem to be solved by the present invention is: in view of the technical difficulties existing in high-strength aluminum alloy field, such as rough treatment process of melt, poor quality, high tendency to hot cracking, poor casting properties, low finished product rate of cast products, low strength at high temperature, and poor reuse of waste scraps and slag, etc., under the guide of high-quality melt, solid solution, and phase diagram theory, optimize the formulation of major elements (i.e., Cu, Mn, and RE elements), and reduce the temperature range of quasi-solid phase in the alloy, to solve the common problems during casting, such as high tendency to hot cracking and low strength at high temperature (including instantaneous strength and long-term strength); select appropriate low-cost multiple micro-alloying elements in the formulation, to create a physical condition for the growth of high-temperature phases and strengthening phases in the solid solution and fining grain; and, optimize the technology and equipment for fusion casting and thermal-treatment (mainly including refining, degassing, purification, degassing and purification with RE complex elements, efficient compounding and modification, crystal control, and special thermal-treatment, etc.), to achieve full growth of high-temperature phases and strengthening phases in the solid solution and full play of fining grain effect. As a result, the present application develops a new RE-containing multi-element micro-alloyed Al—Cu based aluminum alloy material with high-strength and heat-resistant (castability and deformability).

The technical solution of the present invention is the alloying components comprises the following component by weight: Cu: 1.0~10.0%, Mn: 0.05~1.5%, Cd: 0.01~0.5%, Ti: 0.01~0.5%, B: 0.01~0.2% or C, 0.0001~0.15%, Zr: 0.01~1.0%, R: 0.001~3% or ($R_1$+$R_2$): 0.001~3%, RE: 0.05~5%, and Al: the rest.

The characteristic metallic elements R, $R_1$, and $R_2$ are selected from a specific range, including eight kinds of elements: Be, Co., Cr, Li, Mo, Nb, Ni, and W.

The RE comprises can be one rare earth element or a mixture of two or more rare earth elements.

The RE comprises La, Ce, Pr, Nd, Er, Y, and Sc.

The method for preparing the new heat-resistant aluminum alloy with high-strength comprises the following steps:

(1) Selecting a group of feasible element proportions within the element proportion range specified above, calculating the mass of each required metallic elementary substance, or the mass of intermediate alloy, or the mass of mixed metal additive (including salt compound), according to the total weight of alloy to be prepared, working out a list of materials for alloy production, and obtaining the required materials according to the list of materials;

(2) Adding aluminum ingots or molten aluminum liquid in an appropriate amount into a smelting furnace, heating to make the added material completely melt and keep the temperature at 700~800° C.; the melting process should be accomplished in an enclosed environment within a period duration as short as possible, so as to prevent excessive air from taken into the melt;

(3) Adding pure metal of Mn, Ti, Zr, R, $R_1$, $R_2$, or intermediate alloy or mixed metal additive (including salt compound) of Al—Mn, Al—Ti, Al—Zr, Al—R, Al—$R_1$, and Al—$R_2$ according to the formulation, after agitating to homogeneous state, adding pure metal of Cu and Cd, or intermediate alloy or mixed metal additive (including salt) of Al—Cu and Al—Cd, and then adding B, C, and RE elements, and agitating to homogeneous state;

Wherein, the mixed metal additive refers to a cake-shaped or lump-shaped non-sintered powder metallurgical product for adding or adjusting the constituent elements of the alloy. The powder metallurgical product is a mixture of Mn, Cu, Zr, R, $R_1$, $R_2$, B, C, or Ti powder and fusing agent; the fusing agent refers to a mixture of alkali metal haloids or alkaline earth metal haloids (e.g., NaCl, KCl, $Na_3AlF_6$, etc.).

(4) Refining the above-mentioned melt of alloy in a furnace; adding a refining agent (chlorine, hexachloroethane, or manganese chloride as refining agent, or boron salt and carbide, etc., depending on the actual circumstance), and agitating to homogeneous state; the refining of the melt should be accomplished in an enclosed environment as far as possible, to prevent the melt from absorbing moisture and burning loss.

(5) Shattering the slag, standing, and adjusting the temperature to 630~850° C. after refining, and then pouring out the alloy liquid from the furnace, degassing and removing slag on line;

(6) Casting (accomplishing crystal solidification in the mold);

(7) Performing solution treatment for the cast product at 470~560° C. for a period duration of 30 h or less, to prevent the material from over-burnt.

Compared to the prior art, the present invention has the following advantages:

It solves the problems in existing Al—Cu based high-obdurability aluminum alloys (such as ZL201A, ZL204A and ZL205A, etc.) in the prior art, i.e., most of the aluminum alloys employ refined aluminum as the base material and require admixture of noble elements in a content of 1% or higher in the alloy, which results in a high cost and confines the application of Al—Cu based high-obdurability aluminum alloys to frontier fields, such as aerospace and aviation, and national defense and military industry, and limits the application of these aluminum alloys in the field of civil use due to a low cost-performance ratio.

As the yield of aluminum material increases rapidly in China and in the entire world, and the rapid expansion of aluminum industry in China, "replacing steel with aluminum" has gradually become a developing trend in the industry, and there is an urgent need for high-obdurability aluminum alloy products with high cost-performance in the civil field. In the present invention, by utilizing ordinary aluminum as the base material and eliminating (or reducing the content of) noble elements, optimizing the formulation of characteristic micro-alloying elements, and employing intensive, simple and straight fusion casting and purification processes, a new heat-resistant aluminum alloy material with high-strength is developed, and therefore the limit of existing materials in cost is overcome.

Specifically, the present invention has the following eight advantages:

1. High strength and high hardness. Viewed from the aspect of material strength, on the premise of meeting the requirement for plasticity, the strengthening phases can be precipitated and distributed homogeneously and rationally in the as-cast structure by means of technical measures such as thermal-treatment, to attain a material strength of 480~540 MPa and a hardness of HB140 or higher.

2. Double characteristics of the material. Viewed from the purpose of the material, the present material belongs to an aluminum alloy with double characteristics, which has the characteristics of cast aluminum alloy and the characteristics of wrought aluminum alloy, and can be directly used to cast all kinds of light and strong functional parts and structural parts, or cast into rods first and then processed by hot extrusion into profiles with different cross sections.

In nature, the present material belongs to a multiple micro-alloyed cast aluminum alloy; however, owing to the fact that the material has excellent flowability and intercrystalline self-lubricating property, it has the workability characteristic of wrought aluminum alloys.

3. Advanced process. Viewed from the aspect of production process, the traditional rough process is changed in smelting technique, and strictly protected smelting in an electric furnace can be utilized, so as to avoid entrainment of excessive impurities and gasses; therefore, the alloy purity can be ensured, and the complex subsequent melt treatment process can be simplified and shortened; in addition, the smelting process has an energy efficiency much higher than that of the traditional reverberatory smelting process and reduces environmental pollution, and it belongs to a green and energy-saving process.

(1) Protective smelting significantly reduces energy consumption and pollution, simplifies the production procedure, and improves intensiveness degree.

Owing to the fact that the melt of aluminum and aluminum alloy has a strong tendency of air entrainment, the molten alloy liquid will absorb a great deal of gas, such as $O_2$ and moisture in the air, if the material is melted and smelted in an open furnace or a furnace with poor air-tightness, and therefore infusible $Al_2O_3$ and highly active $H_2$ may be created, and entrain impurities and gasses may be formed in the melt, if these substances are not removed timely, the cast products will have defects such as slag inclusion, pores, and loose structure, and may be unacceptable. Wherein, $H_2$ is the most harmful in the melt, because the solubility of $H_2$ in molten aluminum and aluminum alloy is much higher than that in solid aluminum and aluminum alloy, and thereby a great deal of $H_2$ will escape from the alloy and result in many defects when the alloy solidifies. In contrast, the infusible slag is easy to remove. Therefore, it is the principal task to avoid entrainment of gasses in melt, to ensure the quality of the melt and cast product.

Ordinary large-size industrial aluminum alloy smelting furnaces are reverberatory heating furnaces or holding furnaces those utilize liquid fuel or gas fuel as the energy source and require large-volume air supply for combustion-supporting; in addition, the combustion products contain a great deal of substance such as water vapor and $CO_2$ and $NO_X$, etc., which tend to react with aluminum at high temperature and create a variety of harmful impurities; moreover, similar to aluminum liquid, these impurities tend to absorb $H_2$ and therefore cause severe contamination to the melt. Before the casting can be preformed, the melt must be treated through one or more special purification procedures, and then sampled and tested as acceptable; thus, the process procedure is undoubtedly prolonged, and the energy consumption and contamination indexes is difficult to be decreased. In addition, owing to the requirement for production continuity, the equipment has to be large in size, and therefore the investment is high and the technical admittance criteria are elevated; moreover, the required overhaul cost and startup cost of equipment will grow in multiple with the increase of the equipment size and the prolongation of the process procedure.

In ordinary aluminum alloy casting production workshops, seldom enclosing protection measures are taken for the aluminum alloy melt due to small production scale and simple equipment; as a result, the quality of the melt and cast products are poor.

In the preparation method disclosed in the present invention, induction electric heating equipment with a sealing cover is employed for the smelting work; thus, the contamination of the melt from air, water vapor, and various combustion products is eliminated in the combustion process. In addition, a shielding gas can be utilized for gas shielded smelting in the smelting process, and therefore the intrusion of air is minimized. Since the melt is kept in highly pure state, simple through-type degassing and slag-removing devices can be used in the subsequent casting stage, without the need for any specialized hold-type purification equipment. Therefore, the process procedure is greatly simplified.

(2) The heat treatment process of cast products is optimized, and the degradation of mechanical properties of material and the occurrence of waste product resulted from "over-burning" are prevented.

In the patent application No. 200810302670.3, 200810302668.6, 200810302669.0, and 200810302671.8, titled as "High-Strength Cast Aluminum Alloy Material", the parameters of heat treatment of the material are specified as "lower than 620° C. and within 72 h". In material application tests, it is found that the "over-burning" phenomenon often occur when the solution treatment temperature is higher than 560° C., resulting in the destruction to the micro-structure of the material, typically represented by degraded strength and ductility performance, embrittlement of cast product, black or dark surface, etc.; the material may even crack and deform and has to be discarded in the thermal-treatment process. When the solution treatment temperature is lower than 470° C., the material strength can hardly meet the expected target value, due to the insufficient growth of strengthening phases and precipitation strengthening effect. In addition, through tests and trials, it is found that thermal-treatment period duration longer than 30 h has no significant effect on the improvement of material performance. Therefore, to improve the effect and efficiency, the thermal-treatment parameters are optimized as: solution treatment at a temperature of 470~560° C. for a period duration less than 30 h.

4. Scientificalness and economic efficiency of formulation. Viewed from the aspect of material source, an advanced formulation can create advantages in two aspects, that is, the advantage in base material and the advantage in alloying elements. In one aspect, the base alloy of the present new material can be ordinary industrial pure aluminum (e.g., light-gauge aluminum, including aluminum liquid and aluminum ingots for resmelting). Compared to existing high-strength aluminum alloys, which utilize refined aluminum or highly pure aluminum as the base alloy, the present material has advantages such as wide availability of material supply, low cost, and procurement convenience, etc. At the same time, the present material can also utilize refined aluminum or highly pure aluminum as the base alloy, and the material in such a formulation has higher ductility than ordinary aluminum-based materials in the same species. In the other aspect, in view that the contribution of noble elements to the increased cost of the alloy is tens or hundreds of times of the contribution of common elements, the combination of alloying elements in the present new material does not contain noble elements or contains only a trivial proportion of noble elements (usually below 1%). In contrast, the existing high-strength aluminum alloys usually contain noble elements at a proportion higher than 1%. The advantages in the above two aspects provides great potential for the present new material series to occupy the market.

The present invention optimizes copper (Cu) and manganese (Mn) as the major alloy element; further has multiple formulation of micro-alloying elements composed of any one or a combination of any two of characteristic elements selected from beryllium (Be), cobalt (Co), chromium (Cr), lithium (Li), molybdenum (Mo), niobium (Nb), nickel (Ni), and tungsten (W), so as to create a physical condition for the growth of high temperature phases and strengthening phases and grain refining in the solid solution.

On the basis of formation of strengthening θ phase ($Al_2Cu$) and T phase ($Al_{12}Mn_2Cu$) from major elements Cu and Mn in the alloy, an appropriately highly reactive element (Be) can be selected to form dispersed high-temperature strengthening α phase and β phase in the alloy, in order to protect the alloying elements from oxidation, burning loss and gas entrainment, improve metallurgical quality of the alloy and tightness of surface oxidized film, transform ferrous impurities (Fe) from needle shape to pellet shape, and prevent back flushing between the sand mold casting and the mold; the high-temperature element (Co) can be selected to form eight kinds of dispersed high-temperature strengthening phases (including AlCo, $Al_9CO_2$, etc.) in the alloy; in addition, Co is a trace supplement element in complex alloyed high-strength cast aluminum alloys, and, when it coexists with Mn, the two elements form sophisticated interdendritic strengthening phases, which hamper dislocation and prevent crystal grain slippage, and therefore can effectively improve the alloy strength at room temperature and high temperature (up to 400° C.); the high-temperature element Cr can be selected to form five kinds of dispersed high-temperature strengthening phases (including β-$CrAl_7$, η-$Cr_2Al$, etc.) in the alloy; the highly dissoluble element Li can be selected to form five kinds of dispersed high-temperature strengthening phases (including $Al_2Li_3$, $AlLi_5$, etc.) in the alloy, so as to improve the hardness and corrosion resisting property of the alloy; the high-temperature element Mo can be selected to form thirteen kinds of dispersed high-temperature compound strengthening phases ($AlMo_3$~$Al_{12}Mo$, etc.) in the alloy; the high-temperature element Nb can be selected to form strengthening phases of three kinds of dispersed high-temperature compounds ($AlNb_3$, AlNb, and $Al_3Nb$) in the alloy; the high-temperature element Ni can be selected to form five kinds of dispersed high-temperature strengthening phases (including $AlNi_3$, $Al_3Ni$, etc.) in the alloy, to improve the strength and stability of volume and dimensional of the alloy at high temperature and transform ferrous compounds into lump shape, so as to reduce the adverse effects of ferrous impurities; the high-temperature element W can be selected to form three kinds of dispersed high-temperature strengthening phases ($Al_{12}W$, $Al_6W$, and $Al_4W$) in the alloy, so as to improve the strength of the alloy at high temperature.

Rare earth (RE) elements can form a variety of metallic compounds in aluminum alloys (e.g., α-$Al_{11}La_3$, β-$Al_{11}La_3$ and $AlLa_3$, etc. in the case of Al and La; α-$Ce_3Al_{11}$, $CeAl_3$ and $CeAl_2$, etc. in the case of Al and Ce; α-$Al_{11}Pr_3$ and ρ-$AlPr_3$, etc. in the case of Al and Pr; α-$Al_{11}Nd_3$ and $AlNd_3$, etc. in the case of Al and Nd; $Al_{11}Pm_3$ and $AlPm_2$, etc. in the case of Al and Pm; $Al_{11}Sm_3$ and $AlSm_2$, etc. in the case of Al and Sm; $Al_4Eu$ and AlEu, etc. in the case of Al and Eu; $Al_4Gd$ and $Al_{17}Gd_2$, etc. in the case of Al and Gd; $Al_3Tb$ and $AlTb_2$, etc. in the case of Al and Tb; α-$Al_3Dy$ and $AlDy_2$, etc. in the case of Al and Dy; $Al_3Ho$ and $AlHo_2$, etc. in the case of Al and Ho; Al—Er, $Al_3Er$ and $AlEr_2$, etc. in the case of Al and Er; $Al_3Tm$ and AlTm, etc. in the case of Al and Tm; $Al_3Yb$ and $Al_2Yb$, etc. in the case of Al and Yb; $Al_3Lu$ and $AlLu_2$, etc. in the case of Al and Lu; $Al_3Y$ and $AlY_2$, etc. in the case of Al and Y; $Al_3Sc$ and $AlSc_2$, etc. in the case of Al and Sc; in summary, there are almost one hundred of infusible active metallic compounds), and all of the metallic compounds can significantly improve alloy strength at room temperature and high temperature as well as flowability of the melt.

The mechanism of action of the major alloying elements in the present invention is as follows:

① The present material allows for Cu content within the range of 1~10%, which is slightly different from the Cu content range (i.e., 3~11%) in the Al—Cu based cast aluminum alloys, but has great innovative significance in theory.

On one hand, Cu content of 5.65~5.7% is right equal to the eutectic solubility of Cu in Al—Cu alloy; in the thermal-treatment process, following the transformation model and action mechanism of "complete solid solution-homogeneous precipitation-grain boundary strengthening phase-interstitial filler (bonding, embedding, and anti-slippage)", the more of the Cu-rich strengthening phases (including $Al_2Cu$, i.e., θ phase) is formed, so as to greatly improve the mechanical properties of the aluminum alloy at room temperature and high temperature, and improves workability of the aluminum alloy. However, owing to the fact that the solubility of Cu in Al dramatically decreases as the temperature decreases, during the crystal solidification, the degree of supersaturation of Cu in α-Al solid solution increases quickly; therefore, the α-Al dendritic crystals increasingly tends to expel the Cu-rich strengthening phases towards the crystal boundaries as they grow, causing great structural stress between the intra-crystalline part and the crystalline boundaries; in addition, since the entire alloy is in the solidification shrinkage stage, the shrinkage stress superposes on the structural stress; once the total stress surpass the instant physical strength of the alloy, hot cracks will occur. Therefore, within a specific range of Cu content ≤5.65%, the casting property of aluminum alloy is the worst, and the tendency to hot cracking is the highest. However, the overall trend is: as the Cu content decreases, the tendency of hot crack of the alloy will decrease; when the Cu content is <1%, there will be no enough quantity of strengthening phases, and therefore the transformation model and action mechanism of strengthening phases will not take full play; a great deal of defects will be formed at the grain boundaries due to precipitation at the grain boundaries and intra-crystalline dissolution, causing reduced alloy strength at room temperature and high temperature. Therefore, the element Cu has little significance to simple Al—Cu alloys if the Cu content is too low; however, if enough RE elements are added in the alloy, special effects of compensating for low Cu content can be obtained.

On the other hand, when the Cu content is ≥5.7%, the Cu-rich phases will not be absorbed by the matrix completely in the thermal treatment process; instead, they will disperse as Cu-rich metallic compounds near the grain boundaries, decrease the concentration difference between interior and exterior of the α-Al solid solution, moderate the intensity of expelling of Cu-rich phases from the dendrite crystals in the α-Al solid solution towards the grain boundaries in the solidification process, i.e., reduce the structural stress and the tendency to hot cracking. Apparently, when the Cu content is ≥5.7%, the more the Cu-rich phases are, the lower the structural stress and tendency of hot cracking in the alloy will be in the crystallization process. In addition, the fine crystal-dispersed Cu-rich phases with a high melting point form active heterogeneous crystal nuclei during melt crystallization, which accelerates the melt crystallization process but inhibits the growth of crystal nuclei, refines the grain and decrease the tendency to hot cracking in the alloy; moreover, they improve the filling effect between grain boundaries in the matrix; furthermore, the Cu-rich phases can react with a variety of elements such as Al and Mn to form infusion metallic compounds with high melting point. All these actions significantly weaken the surface tension of the melt, decrease the viscosity of the melt, and thereby greatly improve the flowability of the melt and the casting property of the alloy.

When the Cu content is near 5.7%, a great deal of Cu-rich phases (dissolved-precipitated phases) and fewer dispersed phases of fine grain-dispersed phase of Cu-based metallic compounds (about 0.5%) will be formed at the grain boundaries in the matrix after thermal treatment, and therefore the alloy strength at room temperature is high; however, when the alloy is in a high-temperature environment, as a great deal of Cu-rich phases are dissolved into the matrix again, inter-crystalline voids and defects will occur, and will severely degrade the alloy strength at high temperature. As the Cu content increases further, the temperature influence on alloy strength will be reduced; when the disperse phases and precipitated phases are essentially equal in quantity to each other, the temperature influence on material strength is the lowest; at this point, the Cu content in the alloy should be 11~12%.

However, when the Cu content in the alloy is >10%, the surplus Cu in the crystallization process tends to crystallize in precedence and therefore create a huge network structure; as a result, the alloy viscosity is greatly increased, and the surplus phase substitutes the aluminum-matrix to be the principal factor in crystallization control in the crystallization process; consequently, the original beneficial effect of the disperse phase to the aluminum-matrix phase is completely shielded; therefore, the properties of the alloy are severely degraded again.

On the basis of above theory and practical verification, the reasonable range of the major alloying element Cu is determined as 1~10% (wt %).

② The material utilizes element Mn to improve corrosion resistance and shield Fe impurities, so as to reduce the adverse effects of Fe.

Since the element Mn reacts with the matrix to produce $MnAl_6$, which has an electrical potential equal to that of pure aluminum, this element can effectively improve corrosion resistance and weldability of the alloy. In addition, Mn serves as a high-temperature strengthening phase, and can elevate the recrystallization temperature and inhibit coarsing of the recrystal grains, and therefore can achieve solution strengthening and supplement strengthening for the alloy, and enhance heat resistance performance. Under the action of a grain refiner, the element can react with element Fe to create $Al_3$(Fe, Mn) pellets, and thereby effectively eliminate the adverse effects of Fe to the alloy. Therefore, in the present invention, the Fe content can be within a wide range (Fe≤0.5%). The benefits of that approach include replacing refined aluminum with ordinary aluminum, reduce the cost, widen the source of raw material, and expand the application field of the present material.

③ RE elements are mainly used as the micro-alloying base elements in a wide content range up to 5%, to fully utilize the degassing, slag-removing, purification, and grain refining and modification effects of RE elements in the alloy, so as to improve the mechanical properties and corrosion resistance of the alloy.

The degassing, slag-removing, and purification mechanism of RE elements is as follows. RE elements are highly active, has high affinity to O, H, S, and N, etc., and have a deoxidation more powerful than the existing strongest deoxidizing agent (i.e., aluminum), and can reduce oxygen content from $50\times10^{-6}$ to $10\times10^{-6}$ or a lower. In addition, RE elements have strong desulfurization ability and can reduce the S content from $20\times10^{-6}$ to $1-5\times10^{-6}$. Therefore, RE-containing aluminum alloys can easily react with the above-mentioned substances in aluminum liquid during the smelting, and the reaction products are insoluble in aluminum and enter into the slag. As a result, the gas content in the alloy will be reduced, and the tendency to creation of pores and loose structures in the alloy product will be greatly decreased.

RE elements can significantly improve the mechanical properties of alloys. RE elements can form stable high-melting intermetallic compounds in aluminum alloys, such as $Al_4RE$, $Al_8CuRE$, $Al_8Mn_4RE$, and $Al_{24}RE_3Mn$, etc. These high-melting intermetallic compounds are dispersed in inter-crystalline and inter-dendritic crystal in the form of network or skeleton, and bonded firmly to the matrix, performing the functions of strengthening and stabilizing the grain boundary. Moreover, a few of AlSiRE phase is formed in the alloy; owing to its high melting point and hardness, the AlSiRE phase has contribution to the improvement of heat resistance and wear resistance of the alloy. In addition, RE elements can neutralize the impurity elements, such as Sn, Pb, and Sb, etc. with low melting point in the metal liquid, react with them to produce compounds with high melting point or drive them to distribute uniformly from inter-dendritic spaces to the entire crystal structure, and thereby eliminate dendritic structures.

RE elements have grain refining and modification effects. RE elements are surface active elements, and can distribute intensively at the grain boundaries; therefore, they can decrease the viscosity of the melt, increase flowability, reduce the tension force between the phases, and refine the grains because they reduce the work required for forming crystal nuclei at critical dimensions and thereby increase the quantity of crystal nuclei. The modification actions of RE elements on aluminum alloys are long residual actions and have re-smelting stability. Most individual RE element or mixed RE elements have strong refining and modification effects to the α-Al phase after they are added into the alloys.

Furthermore, RE elements can improve the conductivity of alloys. RE elements can refine aluminum crystal grains and react with impurities (e.g., Fe and Si, etc.) in alloys to form stable compounds (e.g., $CeFe_5$, CeSi, and $CeSi_2$, etc.) and precipitate from the crystals; in addition, RE elements have purification effect to alloys; therefore, the electrical resistivity of aluminum is decreased, and the conductivity is increased (by approx. 2%).

Since a small amount of RE elements can have obvious modification effect to the properties of alloy, the amount of RE elements added into aluminum alloys is usually less than 1%. In patent application Nos. 200810302670.3, 200810302668.6, 200810302669.0, and 200810302671.8, the RE content is determined as 0.05~0.3%. Analyzed from the phase diagram of Al-RE alloys, owing to the fact that most RE elements have very low solubility in aluminum (e.g., the solubility of Ce is approx. 0.01%), they usually exist as high-melting intermetallic compounds distributed at grain boundaries or inside of the base crystals. RE elements are consumed partially when they serve as purifying agents in the purification process of the melt due to their high activity. Therefore, if the amount of RE elements added into the alloy is not enough, the modification effect of RE elements to the α-Al phase will not be given full play. To keep the long residual action and re-smelting stability of the modification effect of RE elements and give full play to the high-temperature strengthening effect of RE elements, in the present invention, the RE content is considered along with Cu content, and is determined as 0.05~5%.

④ As a characteristic additive element for complex alloying, element Be can form dispersed high-temperature strengthening α phase and β phase in alloys, prevent oxidation, burning loss, and gas entrainment of alloying elements, improve metallurgical quality and tightness of surface oxidized film of alloys, transform Fe impurities from needle shape to pellet shape, and prevent back flushing between sand mould casting and mold in the casting process.

As a characteristic additive element for complex alloying, element Cr can form five kinds of dispersed high-temperature strengthening phases (such as $\beta$-$CrAl_7$ and $\eta$-$Cr_2Al$, etc.), which are distributed at the grain boundaries and can improve alloy strength at room temperature and high temperature.

As a trace additive element for complex alloying, element Co can form eight kinds of dispersed high-temperature strengthening phases (such as AlCo and $Al_9CO_2$, etc.) in alloys. Element Co is a trace additive element for complex alloying of high-strength cast aluminum alloys. When it coexists with Mn, the two elements can form sophisticated inter-dendritic strengthening phases such as $Al_4$(CoFeMn), which hamper dislocation, prevent crystal grain slippage, and effectively improve alloy strength at room temperature and high temperature (up to 400° C.).

As a trace additive element for complex alloying, element Ni can form five kinds of dispersed high-temperature strengthening phases (such as $AlNi_3$ and $Al_3Ni$, etc.) in alloys, and therefore can improve alloy strength at high temperature and the stability of volumetric and dimensional, and tend to change Fe compounds into lump shape, i.e., reduce adverse effects of Fe impurities.

As a trace additive element for complex alloying, element Li can form five kinds of dispersed high-temperature strengthening phases (such as $Al_2Li_3$ and $AlLi_5$, etc.) in alloys, and therefore improve the hardness and corrosion resisting property of alloys.

As a trace additive element for complex alloying, element Nb can form three kinds of dispersed metallic compound high-temperature strengthening phases (i.e., $AlNb_3$, AlNb, $Al_3Nb$) in alloys.

As a trace additive element for complex alloying, element Mo can form 13 kinds of dispersed metallic compound high-temperature strengthening phases (i.e., $AlMo_3$~$Al_{12}Mo$, etc.) in alloys.

As a trace additive element for complex alloying, element W can form three kinds of dispersed high-temperature strengthening phases (i.e., $Al_{12}W$, $Al_6W$, and $Al_4W$) in alloys, and therefore can improve alloy strength at high temperature.

Above eight kinds of elements can be added separately or in combination of any two elements, the resulted saturated melt and super-saturated solid solution can bring out the functions of solution strengthening, strengthening by strengthening phases, dispersion strengthening, and grain refining to alloys.

5. Superior casting properties. The superior performance of the present new material is verified by casting tests in high-tech structure, aviation, aerospace, and civil heavy industry fields. The casting properties are superior to the existing high-strength cast aluminum alloys such as A201.0, ZL206, ZL207, ZL208, and 206.0, etc., and severe problems in the casting process of aluminum alloy, such as high tendency to hot cracking and low casting yield rate, etc. are solved completely. The secondhand material after re-smelting can be blended with fresh material at any ratio, and the casting properties of the melt mixed by the secondhand material and the fresh material are the same as those of fresh material; and the favorable effects for stabilizing the material strength and improving ductility can be achieved. Compared to the existing high-strength aluminum alloys, which have drawbacks including poor recycle of waste material and long process cycle, the present new material has superior economical efficiency and intensive feature.

The mechanism of elimination of hot cracking tendency of the present new material is as follows. As the Cu content in the alloy increases, Cu-rich phases are formed; these Cu-rich phases are high-melting fine-crystal dispersed phases dispersed in the form of metallic compounds at the grain boundary, which effectively balance out the strong tendency of diffusing Cu-rich solutes in crystals to the grain boundaries due to the rapid increase of super-saturation degree in the crystallization process of the melt, and thereby alleviate the structural stress in the crystallization process. In addition, the Cu-rich dispersed phases, characteristic micro-alloying elements R (Be, Co, Cr, Li, Mo, Nb, Ni, and W), RE micro-alloying elements, and dispersed phases of Mn, Zr, Ti and B, etc. at the grain boundaries have the effects such as grain refining, crystal boundary filling, and creation of metallic compounds that have an electrical potential near to that of aluminum; all these effects greatly reduce the surface tension of the melt, decrease the viscosity of the melt, and thereby significantly improve the flowability of the melt and the casting property of the alloy, and ensure a high acceptance rate of the cast products.

The mechanism of superior recycle performance of the secondhand material is as follows. In the present invention, the multi-element micro-alloying action is a long residual action and has high re- smelting stability. In the re-smelting process, the structure of the melt retain the atom groups and fine crystalline structure formed in the primary melt of alloy, and there are a great deal of active crystal nuclei that performs the functions of agglomerating and assimilating microcrystalline in the melt; and keeps the original flowability. Therefore, the blending with the secondhand material has favorable effects for stabilization of material strength and improvement of ductility.

Since the secondhand material has such favorable properties, it can be recycled immediately on the production site, which is to say, the secondhand material from slag, off-cuts to rejected casting, can be smelted together with the fresh material, or directly added into the melt.

Since the new material disclosed in the present invention has such characteristics, it can greatly improve the finished product rate of the cast products and greatly reduce the rate of waste, when compared to the widely used Series 1XXX and Series 2XXX high-strength aluminum alloy materials. Therefore, it is unnecessary to maintain a large storage yard for the waste on the production site (in actual production, for aluminum alloy casting workshops, often a large storage yard for the waste has to be prepared). In addition, much of cast aluminum alloy lacks re-smelting stability and can not be directly recycled on the site; therefore, they have to be treated centrally in batch, and the treatment accounts for a large part in the production cost, and result in a series of treatment procedures and labor in vain. In contract, with the new material disclosed in the present invention, all these additional procedures, costs, and labor in vain can be eliminated.

6. Superior processing and surface anti-corrosion treatment performance. In processing tests of the present new material into finished products with different shapes, such as shafts, balls, tubes, angle sections, and bolts, etc., the present new material is proved as having excellent workability, and the surface finish of the material can be as high as mirror finish, with light reflectivity higher than that of pure aluminum; surface oxidation and coating tests have shown that the thickness of surface film formed by anodization can meet the specifications in applicable standards, there is no color change on the surface, and the cohesion of coating to the oxidized surface is enough to enable the coating to withstand destructive tests.

7. Superior high-temperature properties. The material has high-temperature properties equivalent to those of high-temperature aluminum alloys, and has a strength of 200 MPa or higher at high temperature up to 400° C., which is higher than the strength of conventional high-temperature (heat-resistant) aluminum alloy materials. With the above feature, the present new material can be used to replace almost all materials for heat-resistant parts, except for the materials for parts directly exposed to high-temperature gas burning, such as aeroengine casings. (For the mechanism of heat resistance for the present material, please see the description on Cu-rich phases, RE, high-temperature and high-activity heat resisting alloying elements Be, Co, Cr, Li, Mo, Nb, Ni, and W in Feature 4 "Scientificalness and economical efficiency of formulation").

8. Representative originality. This series of the new present material are developed by the applicant after making innovative breakthroughs in alloying theory. The verification of the superior material properties is a proofing process of the new alloying theory. Such a theoretical breakthrough has never been documented in any literature. Therefore, this series of the new material belong to a major original and fundamental innovation in the world.

Innovative Points of the Present Invention

Table 1 lists the elementary compositions of 31 kinds of aluminum alloys those are similar to the new material disclosed in the present invention in terms of one of the performances or applications. It is seen that the present invention mainly has the following innovative points, when compared to the existing wrought aluminum alloys with high Cu-content, heat-resistant wrought aluminum alloys, and heat-resistant cast aluminum alloys.

First, the present new material allows for a wide Cu-content range (1~10%), and can work with element Mn to produce a variety of high-temperature strengthening phases.

Second, the present new material mainly utilizes RE elements as fundamental micro-alloying elements, and the RE content range is very wide, up to 5%, so that the degassing, slag-removing, purification, grain refining, and modification effects of RE elements in alloys can be fully utilized, to improve the mechanical properties and corrosion resistance of alloys. RE elements have high affinity to O, S, N, and H, and therefore have high effects of deoxidation, desulphurization, dehydrogenation, and denitrification. Furthermore, RE elements are surface active elements, which tend to distribute mainly at the grain boundaries, and can reduce the inter-phase tension force, because they reduce the work required to form crystal nuclei at the critical dimensions and increase the quantity of crystal nuclei, and thereby refine the grains.

Third, the present new material has less restriction to element Fe and permits a wide range of Fe content up to 0.5%, and therefore opens a wide space for utilizing ordinary aluminum as base material for melt casting of alloy materials.

Fourth, since the new material does not use low-melting elements (e.g., Mg and Zn, etc.) to produce strengthening phases, it can avoid decomposition and transformation of strengthening phases at high temperature, and thereby greatly improve the material strength at high temperature.

Fifth, any one or a combination of any two of eight kinds of typical elements Be, Co, Cr, Li, Mo, Nb, Ni, and W are utilized as highly active characteristic additive elements for complex micro-alloying; these elements can form a variety of high-temperature strengthening phases in the melt, and can serve as modifier to improve alloy strength at room temperature and high temperature. These elements, together with elements titanium (Ti), boron (B), carbon (C), and zirconium (Zr) as general grain refiners and element Cd as catalyst and lubricant for the formation of strengthening phases, set a physical foundation for the alloy material to obtain all superior properties, including high strength, high toughness, high heat resistance, and high flowability of melt, etc.

The above-mentioned features are the five major features of the material formulation in the present invention.

TABLE 1

Chemical composition of different aluminum alloys related to the present invention
Comparison of composition between wrought aluminum alloys with high Cu-content, heat-resistant wrought aluminum alloys, heat-resistant cast aluminum alloys, and the material disclosed in the present invention I. Wrought aluminum alloys with high Cu-content

| No. | Designation/ Name | Si | Fe | Cu | Mn | Mg | Zn | Ti | B | Zr | V | |
|---|---|---|---|---|---|---|---|---|---|---|---|---|
| 1 | 2001 | 0.20 | 0.20 | 5.2~6.0 | 0.15~0.50 | 0.20~0.45 | 0.10 | 0.20 | — | 0.05 | — | 0.05 Ni; 0.10 Cr |
| 2 | 2004 | 0.20 | 0.20 | 5.5~6.5 | 0.10 | 0.50 | 0.10 | 0.20 | — | 0.30~0.50 | — | |
| 3 | 2011 | 0.40 | 0.7 | 5.0~6.0 | — | — | 0.30 | — | — | — | — | |
| 4 | 2011A | 0.40 | 0.50 | 4.5~6.0 | — | — | 0.30 | — | — | — | — | |
| 5 | 2111 | 0.40 | 0.7 | 5.0~6.0 | — | — | 0.30 | — | — | — | — | |
| 6 | 2219 | 0.20 | 0.30 | 5.8~6.8 | 0.20~0.40 | 0.02 | 0.10 | 0.02~0.10 | — | 0.1~0.25 | 0.05~0.15 | |
| 7 | 2319 | 0.20 | 0.30 | 5.8~6.8 | 0.20~0.40 | 0.02 | 0.10 | 0.10~0.20 | — | 0.1~0.25 | 0.05~0.15 | |
| 8 | 2419 | 0.15 | 0.15 | 5.8~6.8 | 0.20~0.40 | 0.02 | 0.10 | 0.20~0.10 | — | 0.1~0.25 | 0.05~0.15 | |
| 9 | 2519 | 0.25 | 0.30 | 5.3~6.4 | 0.10~0.50 | 0.05~0.40 | 0.10 | 0.02~0.10 | — | 0.1~0.25 | 0.05~0.15 | |
| 10 | 2021 | 0.20 | 0.30 | 5.3~6.6 | 0.20~0.40 | 0.02 | 0.10 | 0.02~0.10 | — | 0.1~0.25 | 0.05~0.15 | |
| 11 | 2A16 | 0.30 | 0.30 | 6.0~7.0 | 0.40~0.8 | 0.05 | 0.10 | 0.1~0.2 | — | — | — | |
| 12 | 2B16 | 0.25 | 0.30 | 5.8~6.8 | 0.20~0.4 | 0.05 | — | 0.08~0.2 | — | 0.1~0.25 | 0.05~0.15 | |
| 13 | 2A17 | 0.30 | 0.30 | 6.0~7.0 | 0.40~0.8 | 0.25~0.45 | 0.10 | 0.1~0.2 | — | — | — | |
| 14 | 2A20 | 0.20 | 0.30 | 5.8~6.8 | — | 0.02 | 0.10 | 0.07~0.16 | 0.001~0.01 | 0.1~0.25 | 0.05~0.15 | |

II. Heat resistant wrought aluminum alloys with high strength

| No. | Designation/Name | Si | Fe | Cu | Mn | Mg | Zn | Ti | B | Zr | V |
|---|---|---|---|---|---|---|---|---|---|---|---|
| 1 | 2A01 | 0.5 | 0.5 | 2.2~3.0 | 0.2 | 0.2~0.5 | 0.1 | 0.15 | | | |
| 2 | 2A02 | 0.3 | 0.3 | 2.6~3.2 | 0.45~0.7 | 2.0~2.4 | 0.1 | 0.15 | | | |
| 3 | 2A10 | 0.25 | 0.2 | 3.9~4.5 | 0.3~0.5 | 0.15~0.3 | 0.1 | 0.15 | | | |

TABLE 1-continued

Chemical composition of different aluminum alloys related to the present invention
Comparison of composition between wrought aluminum alloys with high Cu-content, heat-resistant wrought aluminum alloys, heat-resistant cast aluminum alloys, and the material disclosed in the present invention

| | | | | | | | | | |
|---|---|---|---|---|---|---|---|---|---|
| 4 | 2A12 | 0.5 | 0.5 | 3.8~4.9 | 0.3~0.9 | 1.2~1.8 | 0.3 | 0.15 | |
| 5 | 7A04 | 0.5 | 0.5 | 1.4~2.0 | 0.2~0.6 | 1.8~2.8 | 5.0~7.0 | 0.1 | 0.1~0.25Cr |

III. Heat resistant cast aluminum alloys with high-strength

| No. | Designation/Name | Si | Fe | Cu | Mn | Mg | Zn | Ti | B | Zr | V | |
|---|---|---|---|---|---|---|---|---|---|---|---|---|
| 1 | ZL107A | 6.5~7.5 | | 3.5~4.5 | | 0.1~0.2 | | 0.1~0.2 | 0.01~0.05 | | | 0.04~0.1Be<br>0.1~0.2Cd |
| 2 | ZL201A | ≤0.3 | ≤0.15 | 4.8~5.3 | 0.3~1.0 | | | 0.15~0.35 | | | | |
| 3 | ZL205A | ≤0.06 | ≤0.15 | 4.8~5.3 | 0.3~0.5 | | | 0.15~0.35 | 0.005~0.060 | 0.05~0.2 | 0.05~0.30 | 0.15~0.25Cd |
| 4 | High toughness 205A | | | 4.6~5.3 | 0.3~0.5 | | | 0.05~0.25 | 0.05~0.10 | 0.05~0.25 | 0.10~0.25 | |
| 5 | ZL206 | ≤0.3 | ≤0.5 | 7.6~8.4 | 0.7~1.1 | ≤0.2 | ≤0.4 | ≤0.05 | 0.05~0.10 | 0.1~0.25 | 0.10~0.25 | 0.2~0.3Ni;<br>1.5~2.3RE |
| 6 | ZL207 | 1.6~2.0 | ≤0.6 | 3.0~3.4 | 0.9~1.2 | 0.15~0.25 | 0.2 | — | 0.05~0.10 | 0.15~0.25 | 0.10~0.25 | 0.2~0.3Ni;<br>4.4~5.0RE |
| 7 | ZL208 | ≤0.3 | ≤0.5 | 4.5~5.5 | 0.2~0.3 | | | 0.15~0.25 | 0.05~0.10 | 0.1~0.3 | 0.10~0.25 | 1.3~1.8Ni;<br>0.1~0.4Co;<br>0.1~0.4Sb |
| 8 | A-U5GT | ≤0.20 | ≤0.35 | 4.2~4.5 | | 0.15~0.35 | | 0.05~0.30 | | | | |
| 9 | 206.0 | ≤0.10 | ≤0.35 | 4.2~4.5 | 0.2~0.5 | 0.15~0.35 | | 0.15~0.35 | | | | |
| 10 | KO-1 | ≤0.10 | ≤0.35 | 4.0~5.2 | 0.2~0.5 | 0.15~0.55 | | 0.15~0.35 | | | | Ag: 0.4~1.0 |
| 11 | ZL301 | | | | | 9.5~11.0 | | | | | | |

IV. Alloys disclosed in the 4 patent applications (200810302670.3, etc.) and the present invention

| No. | Designation/Name | Si | Fe | Cu | Mn | Ti | B/C | Zr | |
|---|---|---|---|---|---|---|---|---|---|
| 1 | High-Strength Cast Aluminum Alloy | — | — | 2~6 | 0.05~1.0 | 0.01~0.5 | B: 0.005~0.04 | 0.01~0.25 | 0.01~0.2 Cr;<br>0.05~0.3 RE;<br>0.01~0.4 Cd |
| 2 | Present invention | ≤0.1 | ≤0.5 | 1~10 | 0.05~1.5 | 0.01~0.5 | B: 0.01~0.2<br>or<br>C: 0.0001~0.15 | 0.01~1.0 | 0.001~3 R or<br>0.001~3.0 ($R_1 + R_2$);<br>0.05~5 RE;<br>0.01~0.5 Cd |

Note 1:
In the present invention, there only 8 candidate elements for R, $R_1$, and $R_2$, including: Be, Co, Cr, Li, Mo, Nb, Ni, and W.
Note 2:
In the alloys listed in this table, the content of any other impurity element is not higher than 0.05%, the total content of other impurity elements is not higher than 0.15%; in addition, the rest content is Al.

Comparison of Mechanical Properties

The applicant has compared the mechanical properties between the alloy disclosed in the present invention and several high-obdurability aluminum alloys, as shown in Table 2.

TABLE 2

Comparison of mechanical properties between the alloy disclosed in the present invention and several high-obdurability cast aluminum alloys

| Designation of Alloy | Casting Method | Heat Treated State | Tensile Strength, $\sigma_b$ MPa | Elongation, $\delta_5$ % | Hardness, HBS |
|---|---|---|---|---|---|
| ZL201A | S | T4 | 365~370 | 17~19 | 100 |
| | S | T5 | 440~470 | 8~15 | 120 |
| ZL205A | S | T5 | 480 | 13 | 120 |
| | S | T6 | 510 | 7 | 140 |
| | S | T7 | 495 | 3.4 | 130 |
| Highly toughness 205A | J | T5 | 385~405 | 19~23 | |
| 206.0① | S | T7 | 435 | 11.7 | 90 |
| KO-1 | S | T6 | 460 | 5.0 | 135 |
| | J | T6 | 460 | 9.0 | |
| | R | T5 | 358~450 | 4.0~7.0 | |

TABLE 2-continued

Comparison of mechanical properties between the alloy disclosed in the present invention and several high-obdurability cast aluminum alloys

| Designation of Alloy | Casting Method | Heat Treated State | Tensile Strength, $\sigma_b$ MPa | Elongation, $\delta_5$ % | Hardness, HBS |
|---|---|---|---|---|---|
| ZL107A | J | T5 | 420~470 | 4~6 | |
| Present invention | J, S | T6 | 480~540 | 3~8 | 140 |

①The data listed in the table is that of highly pure alloy 206.0, i.e., W(Si) ≤ 0.05%, W(Fe) ≤ 0.10%.
S—sand mold casting,
J—metal mold casting,
R—investment mold casting It is seen from Table 2 that the present invention has a tensile strength of 480~540 MPa and a hardness higher than HB140, obviously superior to the mechanical properties of the existing high-obdurability aluminum alloys.

3. High-Temperature Properties

The applicant has tested the creep-rupture strength at high temperature of the alloy disclosed in the present invention under different temperature conditions, and compared the obtained data with the data of the existing common heat-resistant aluminum alloys, as shown in Table 3.

TABLE 3

Comparison of creep-rupture strength at high temperature between the alloy disclosed in the present invention and common heat-resistant aluminum alloys

| Designation of Alloy | Heat Treated State | Strength at high temperature in a period duration of 100 h | | |
|---|---|---|---|---|
| | | σ(200° C.) | σ(250° C.) | σ(300° C.) |
| ZL201 | T4 | 120 | 80 | 50 |
| ZL201A | T5 | 165 | — | 80 |
| ZL204A | T5 | 100 | 65 | — |
| ZL205A | T5 | 90 | 70 | — |
| | T6 | 80 | 70 | — |
| ZL206A | T7 | — | 135 | 90 |
| ZL207A | T1 | 155 | 125 | 80 |
| ZL208A | T7 | — | 135 | 90 |
| 2A01 | T4 | 200 | 120 | 95 |
| 2A02 | T6 | 370 | 240 | 110 |
| 2A10 | T6 | 280 | 235 | 147 |
| 2A12 | T4 | 420 | 290 | 190 |
| 7A04 | T6 | 280 | 150 | — |
| BAJI10 | ST5 | 100 | 75 | 40 |
| | JT6 | 100 | 75 | |
| Present invention | ST6 | 450~510 | 320 | 200 |
| | JT6 | 480~520 | 380 | 260 |

It is seen from Table 3 that the strength of the alloy disclosed in the present invention is higher than 450 MPa at room temperature and is 300 MPa or higher at a temperature of 250° C.; the creep-rupture strength of the alloy is higher than 200 MPa at a temperature of 300° C., obviously superior to the data of the existing heat-resistant alloys with high-strength.

In summary, the new heat-resistant aluminum alloy material with high-strength disclosed in the present invention has high technical level, can be applied in a wide field, and shows an excellent market prospect. With its outstanding cost-performance ratio, the present alloy can substitute almost all the existing high-strength aluminum alloys and high-temperature aluminum alloys, and can represent the developing trend of high-strength constructional materials with light weight in China and even in the entire world.

DETAILED DESCRIPTION OF THE EMBODIMENTS

Example 1

Cu-1.0%; Characteristic Micro-alloying Elements—Be and Cr; Fundamental Micro-alloying RE Element—La (1) Weigh the required alloying elements according to the following formula calculation table.

| | Element | | | | | | | | | |
|---|---|---|---|---|---|---|---|---|---|---|
| | Al | Cu | Mn | Cd | Zr | Be | Cr | Ti | La | B |
| Mass (g) | 7155.9 | 80 | 120 | 36 | 80 | 0.1 | 80 | 40 | 400 | 8 |
| Total | 8000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Be, Al—Cr and Al—Zr (including salt compounds) in the proportions indicated in the formula, agitate to homogeneous state; then add pure metal of Cu and intermediate alloy or mixed metal additive of Al—Cd; next add B and RE element La, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Be, Cr, B, or Ti with flux. The flux refers to a mixture of alkali metal haloids or alkali-earth metal haloids, including NaCl, KCl, and $Na_3AlF_6$.

(4) Refine the above-mentioned melt of alloy in the furnace; add a refining agent (chlorine, hexachloroethane, or manganese chloride etc. as refining agent, and boron salt as modifier, depending on the actual circumstance) into the melt of alloy; and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 535 MPa, elongation: 8%.

Example 2

Cu-4.2%; Characteristic Micro-alloying Elements—Be and Cr; Fundamental Micro-alloying RE Elements—RE Mixture of La and Ce (1) Weigh the required alloying elements according to the following formula calculation table.

| | Element | | | | | | | | | |
|---|---|---|---|---|---|---|---|---|---|---|
| | Al | Cu | Mn | Cd | Zr | Be | Cr | Ti | La and Ce mixed RE | B |
| Mass (g) | 7323.6 | 336 | 64 | 24 | 64 | 0.4 | 64 | 32 | 80 | 12 |
| Total | 8000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Be, Al—Cr and Al—Zr (including salt compounds) in the proportions indicated in the formula, agitate to homogeneous state; then add pure metal of Cu and intermediate alloy or mixed metal additive of Al—Cd; next add B and RE Mixture of La and Ce, and agitate to homogeneous state.

Wherein, the mixed metal additive refers to a cake-shaped or lump-shaped non-sintered powder metallurgy product for adding or adjusting the constituent elements of the alloy, prepared by mixing the metal powder of Mn, Cu, Zr, Be, Cr, B, or Ti with flux. The flux refers to a mixture of alkali metal haloids or alkali-earth metal haloids, including NaCl, KCl, and $Na_3AlF_6$.

(4) Refine the above-mentioned melt of alloy in the furnace; add a refining agent (chlorine, hexachloroethane, or manganese chloride etc. as refining agent, or boron salt as modifier, depending on the actual circumstance); and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 515 MPa, elongation: 6.2%.

Example 3

Cu-6.01%; Characteristic Micro-alloying Elements—Be and Cr; Fundamental Micro-alloying RE Elements—RE Mixture of La, Ce, and Pr (1) Weigh the required alloying elements according to the following formula calculation table.

| | Element | | | | | | | | | |
|---|---|---|---|---|---|---|---|---|---|---|
| | Al | Cu | Mn | Cd | Zr | Be | Cr | Ti | RE mixture of La, Ce, and Pr | B |
| Mass (g) | 7178.2 | 480.8 | 64 | 24 | 64 | 1 | 64 | 32 | 80 | 12 |
| Total | 8000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Be, Al—Cr and Al—Zr (including salt compounds) in the proportions indicated in the formula, agitate to homogeneous state; then add pure metal of Cu and intermediate alloy or mixed metal additive of Al—Cd; next add B and RE Mixture of La, Ce, and Pr, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Be, Cr, B, or Ti with flux. The flux refers to a mixture of alkali metal haloids or alkali-earth metal haloids, including NaCl, KCl, and $Na_3AlF_6$.

(4) Refine the above-mentioned melt of alloy in the furnace; add a refining agent (chlorine, hexachloroethane, or manganese chloride etc. as refining agent, or boron salt as modifier, depending on the actual circumstance) into the melt of alloy; and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 535 MPa, elongation: 5%.

Example 4

Cu-8%; Characteristic Micro-alloying Elements—Be and Cr; Fundamental Micro-alloying RE Element—Nd (1) Weigh the required alloying elements according to the following formula calculation table.

| | Element | | | | | | | | | |
|---|---|---|---|---|---|---|---|---|---|---|
| | Al | Cu | Mn | Cd | Zr | Be | Cr | Ti | Nd | B |
| Mass (g) | 7143.4 | 640 | 40 | 20 | 40 | 1.6 | 50 | 28 | 30 | 7 |
| Total | 8000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Be, Al—Cr and Al—Zr (including salt compounds) in the proportions indicated in the formula, agitate to homogeneous state; then add pure metal of Cu and intermediate alloy or mixed metal additive of Al—Cd; next add B and RE element Nd, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Be, Cr, B, or Ti with flux. The flux refers to a mixture of alkali metal haloids or alkali-earth metal haloids, including NaCl, KCl, and $Na_3AlF_6$.

(4) Refine the above-mentioned melt of alloy in the furnace; add a refining agent (chlorine, hexachloroethane, or manganese chloride etc. as refining agent, or boron salt as modifier, depending on the actual circumstance) into the melt of alloy; and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 523 MPa, elongation: 4%.

Example 5

Cu-7%; Characteristic Micro-alloying Elements—Be and Cr; Fundamental Micro-alloying RE Element—Er (1) Weigh the required alloying elements according to the following formula calculation table.

| | Element | | | | | | | | | |
|---|---|---|---|---|---|---|---|---|---|---|
| | Al | Cu | Mn | Cd | Zr | Be | Cr | Ti | Er | B |
| Mass (g) | 7221 | 560 | 40 | 20 | 40 | 4 | 50 | 28 | 30 | 7 |
| Total | 8000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Be, Al—Cr and Al—Zr (including salt compounds) in the proportions indicated in the formula, agitate to homogeneous state; then add pure metal of Cu and intermediate alloy or mixed metal additive of Al—Cd; next add B and RE element Er, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Be, Cr, B, or Ti with flux. The flux refers to a mixture of alkali metal haloids or alkali-earth metal haloids, including NaCl, KCl, and $Na_3AlF_6$.

(4) Refine the above-mentioned melt of alloy in the furnace; add a refining agent (chlorine, hexachloroethane, or manganese chloride etc. as refining agent, and boron salt as modifier, depending on the actual circumstance) into the melt of alloy; and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 535 MPa, elongation: 4.7%.

Example 6

Cu-10.0%; Characteristic Micro-alloying Elements—Be and Cr; Fundamental Micro-alloying RE Element—Y (1) Weigh the required alloying elements according to the following formula calculation table.

| | Element | | | | | | | | | |
|---|---|---|---|---|---|---|---|---|---|---|
| | Al | Cu | Mn | Cd | Zr | Be | Cr | Ti | Y | B |
| Mass (g) | 7093 | 800 | 20 | 10 | 20 | 8 | 25 | 15 | 4 | 5 |
| Total | 8000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Be, Al—Cr and Al—Zr (including salt compounds) in the proportions indicated in the formula, agitate to homogeneous state; then add pure metal of Cu and intermediate alloy or mixed metal additive of Al—Cd; next add B and RE element Y, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Be, Cr, B, or Ti with flux. The flux refers to a mixture of alkali metal haloids or alkali-earth metal haloids, including NaCl, KCl, and $Na_3AlF_6$.

(4) Refine the above-mentioned melt of alloy in the furnace; add a refining agent (chlorine, hexachloroethane, or manganese chloride etc. as refining agent, and boron salt as modifier, depending on the actual circumstance) into the melt of alloy; and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 485 MPa, elongation: 3%.

Example 7

Cu-1.0%; Characteristic Micro-alloying Elements—Co and Ni; Fundamental Micro-alloying RE Element—La (1) Weigh the required alloying elements according to the mix calculation table, as follows:

| | Element | | | | | | | | | |
|---|---|---|---|---|---|---|---|---|---|---|
| | Al | Cu | Mn | Cd | Zr | Co | Ni | Ti | La | B |
| Mass (g) | 7076 | 80 | 120 | 36 | 80 | 80 | 80 | 40 | 400 | 8 |
| Total | 8000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Co, Al—Ni and Al—Zr (including salt compounds) in the proportions indicated in the formula, agitate to homogeneous state; then add pure metal of Cu and intermediate alloy or mixed metal additive of Al—Cd; next add B and RE element La, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Co, Ni, B, or Ti with flux. The flux refers to a mixture of alkali metal haloids or alkali-earth metal haloids, including NaCl, KCl, and $Na_3AlF_6$.

(4) Refine the above-mentioned melt of alloy in the furnace; add a refining agent (chlorine, hexachloroethane, or manganese chloride etc. as refining agent, and boron salt as modifier, depending on the actual circumstance) into the melt of alloy; and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 485 MPa, elongation: 7.5%.

Example 8

Cu-4.2%; Characteristic Micro-alloying Elements—Co and Ni; Fundamental Micro-alloying RE Elements—RE Mixture of La and Ce (1) Weigh the required alloying elements according to the following formula calculation table.

| | Element | | | | | | | | | |
|---|---|---|---|---|---|---|---|---|---|---|
| | Al | Cu | Mn | Cd | Zr | Co | Ni | Ti | RE mixture of La and Ce | B |
| Mass (g) | 7260 | 336 | 64 | 24 | 64 | 64 | 64 | 32 | 80 | 12 |
| Total | 8000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Co, Al—Ni and Al—Zr (including salt compounds) in the proportions indicated in the formula, agitate to homogeneous state; then add pure metal of Cu and intermediate alloy or mixed metal additive of Al—Cd; next, add B and RE Mixture of La and Ce, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Co, Ni, B, or Ti with flux. The flux refers to a mixture of alkali metal haloids or alkali-earth metal haloids, including NaCl, KCl, and $Na_3AlF_6$.

(4) Refine the above-mentioned melt of alloy in the furnace; add a refining agent (chlorine, hexachloroethane, or manganese chloride etc. as refining agent, and boron salt as modifier, depending on the actual circumstance) into the melt of alloy; and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 538 MPa, elongation: 7.4%.

Example 9

Cu-5.1%; Characteristic Micro-alloying Elements—Co and Ni; Fundamental Micro-alloying RE Element—Eu (1) Weigh the required alloying elements according to the mix calculation table, as follows:

| | Element | | | | | | | | | |
|---|---|---|---|---|---|---|---|---|---|---|
| | Al | Cu | Mn | Cd | Zr | Co | Ni | Ti | Eu | B |
| Mass (g) | 8956 | 510 | 70 | 30 | 50 | 60 | 60 | 50 | 200 | 14 |
| Total | 10000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Co, Al—Ni and Al—Zr (including salt compounds) in the proportions indicated in the formula, agitate to homogeneous state; then add pure metal of Cu and intermediate alloy or mixed metal additive of Al—Cd; next add B and RE element Eu, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Co, Ni, B, or Ti with flux. The flux refers to a mixture of alkali metal haloids or alkali-earth metal haloids, including NaCl, KCl, and $Na_3AlF_6$.

(4) Refine the above-mentioned melt of alloy in the furnace; add a refining agent (chlorine, hexachloroethane, or manganese chloride etc. as refining agent, and boron salt as modifier, depending on the actual circumstance) into the melt of alloy; and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 503 MPa, elongation: 6.1%.

Example 10

Cu-6.01%; Characteristic Micro-alloying Elements—Co and Ni; Fundamental Micro-alloying RE Elements—RE Mixture of La, Ce, and Pr (1) Weigh the required alloying elements according to the mix calculation table, as follows:

| | Element | | | | | | | | | |
|---|---|---|---|---|---|---|---|---|---|---|
| | Al | Cu | Mn | Cd | Zr | Co | Ni | Ti | RE mixture of La, Ce, and Pr | B |
| Mass (g) | 7115.2 | 480.8 | 64 | 24 | 64 | 64 | 64 | 32 | 80 | 12 |
| Total | 8000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Co, Al—Ni and Al—Zr (including salt compounds) in the proportions indicated in the formula, agitate to homogeneous state; then add pure metal of Cu and intermediate alloy or mixed metal additive of Al—Cd; next add B and RE Mixture of La, Ce, and Pr, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Co, Ni, B, or Ti with flux. The flux refers to a mixture of alkali metal haloids or alkali-earth metal haloids, including NaCl, KCl, and $Na_3AlF_6$.

(4) Refine the above-mentioned melt of alloy in the furnace; add a refining agent (chlorine, hexachloroethane, or manganese chloride etc. as refining agent, and boron salt as modifier, depending on the actual circumstance) into the melt of alloy; and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 533 MPa, elongation: 7.1%.

Example 11

Cu-6.5%; Characteristic Micro-alloying Elements—Co and Ni; Fundamental Micro-alloying RE Element—Er (1) Weigh the required alloying elements according to the following formula calculation table.

| | Element | | | | | | | | | |
|---|---|---|---|---|---|---|---|---|---|---|
| | Al | Cu | Mn | Cd | Zr | Co | Ni | Ti | Er | B |
| Mass (g) | 7123 | 520 | 50 | 32 | 40 | 80 | 80 | 28 | 40 | 7 |
| Total | 8000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Co, Al—Ni and Al—Zr (including salt compounds) in the proportions indicated in the formula, agitate to homogeneous state; then add pure metal of Cu and intermediate alloy or mixed metal additive of Al—Cd; next add B and RE element Er, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Co, Ni, B, or Ti with flux. The flux refers to a mixture of alkali metal haloids or alkali-earth metal haloids, including NaCl, KCl, and $Na_3AlF_6$.

(4) Refine the above-mentioned melt of alloy in the furnace; add a refining agent (chlorine, hexachloroethane, or manganese chloride etc. as refining agent, and boron salt as modifier, depending on the actual circumstance) into the melt of alloy; and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 527 MPa, elongation: 6.9%.

Example 12

Cu-7%; Characteristic Micro-alloying Elements—Co and Ni; Fundamental Micro-alloying RE Element—Nd (1) Weigh the required alloying elements according to the mix calculation table, as follows:

| | Element | | | | | | | | | |
|---|---|---|---|---|---|---|---|---|---|---|
| | Al | Cu | Mn | Cd | Zr | Co | Ni | Ti | Nd | B |
| Mass (g) | 10841 | 840 | 60 | 48 | 100 | 12 | 12 | 60 | 12 | 15 |
| Total | 12000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Co, Al—Ni and Al—Zr (including salt compounds) in the proportions indicated in the formula, agitate to homogeneous state; then add pure metal of Cu and intermediate alloy or mixed metal additive of Al—Cd; next add B and RE element Nd, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Co, Ni, B, or Ti with flux. The flux refers to a mixture of alkali metal haloids or alkali-earth metal haloids, including NaCl, KCl, and $Na_3AlF_6$.

(4) Refine the above-mentioned melt of alloy in the furnace; add a refining agent (chlorine, hexachloroethane, or manganese chloride etc. as refining agent, and boron salt as modifier, depending on the actual circumstance) into the melt of alloy; and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 517 MPa, elongation: 5.2%.

Example 13

Cu-8%; Characteristic Micro-alloying Elements—Co and Ni; Fundamental Micro-alloying RE Element—Ce (1) Weigh the required alloying elements according to the following formula calculation table.

| | Element | | | | | | | | | |
|---|---|---|---|---|---|---|---|---|---|---|
| | Al | Cu | Mn | Cd | Zr | Co | Ni | Ti | Ce | B |
| Mass (g) | 10671 | 960 | 72 | 60 | 96 | 15 | 15 | 60 | 36 | 15 |
| Total | 12000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Co, Al—Ni and Al—Zr (including salt compounds) in the proportions indicated in the formula, agitate to homogeneous state; then add pure metal of Cu and intermediate alloy or mixed metal additive of Al—Cd; next add B and RE element Ce, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Co, Ni, B, or Ti with flux. The flux refers to a mixture of alkali metal haloids or alkali-earth metal haloids, including NaCl, KCl, and $Na_3AlF_6$.

(4) Refine the above-mentioned melt of alloy in the furnace; add a refining agent (chlorine, hexachloroethane, or manganese chloride etc. as refining agent, and boron salt as modifier, depending on the actual circumstance) into the melt of alloy; and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 501 MPa, elongation: 4.8%.

Example 14

Cu-10%; Characteristic Micro-alloying Elements—Co and Ni; Fundamental Micro-alloying RE Element—Y (1) Weigh the required alloying elements according to the following formula calculation table.

| | Element | | | | | | | | | |
|---|---|---|---|---|---|---|---|---|---|---|
| | Al | Cu | Mn | Cd | Zr | Co | Ni | Ti | Y | B |
| Mass (g) | 10485 | 1200 | 60 | 48 | 72 | 18 | 18 | 60 | 24 | 15 |
| Total | 12000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Co, Al—Ni and Al—Zr (including salt compounds) in the proportions indicated in the formula, agitate to homogeneous state; then add pure metal of Cu and intermediate alloy or mixed metal additive of Al—Cd; next add B and RE element Y, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Co, Ni, B, or Ti with flux. The flux refers to a mixture of alkali metal haloids or alkali-earth metal haloids, including NaCl, KCl, and $Na_3AlF_6$.

(4) Refine the above-mentioned melt of alloy in the furnace; add a refining agent (chlorine, hexachloroethane, or manganese chloride etc. as refining agent, and boron salt as modifier, depending on the actual circumstance) into the melt of alloy; and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 487 MPa, elongation: 4.3%.

Example 15

Cu-1.0%; Characteristic Micro-alloying Elements—Li and Nb; Fundamental Micro-alloying RE Element—La (1) Weigh the required alloying elements according to the following formula calculation table.

| | Element | | | | | | | | | |
|---|---|---|---|---|---|---|---|---|---|---|
| | Al | Cu | Mn | Cd | Zr | Li | Nb | Ti | La | B |
| Mass (g) | 7076 | 80 | 120 | 36 | 80 | 80 | 80 | 40 | 400 | 8 |
| Total | 8000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Li, Al—Nb and Al—Zr (including salt compounds) in the proportions indicated in the formula, agitate to homogeneous state; then add pure metal of Cu and intermediate alloy or mixed metal additive of Al—Cd; next add B and RE element La, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Li, Nb, B, or Ti with flux. The flux refers to a mixture of alkali metal haloids or alkali-earth metal haloids, including NaCl, KCl, and $Na_3AlF_6$.

(4) Refine the above-mentioned melt of alloy in the furnace; add a refining agent (chlorine, hexachloroethane, or manganese chloride etc. as refining agent, and boron salt as modifier, depending on the actual circumstance) into the melt of alloy; and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 485 MPa, elongation: 7.5%.

Example 16

Cu-4.2%; Characteristic Micro-alloying Elements—Li and Nb; Fundamental Micro-alloying RE Elements—RE Mixture of La and Ce (1) Weigh the required alloying elements according to the following formula calculation table.

| | Element | | | | | | | | | |
|---|---|---|---|---|---|---|---|---|---|---|
| | Al | Cu | Mn | Cd | Zr | Li | Nb | Ti | RE mixture of La and Ce | B |
| Mass (g) | 7316 | 336 | 64 | 24 | 64 | 8 | 64 | 32 | 80 | 12 |
| Total | 8000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Li, Al—Nb and Al—Zr (including salt compounds) in the proportions indicated in the formula, agitate to homogeneous state; then add pure metal of Cu and intermediate alloy or mixed metal additive of Al—Cd; next add B and RE Mixture of La and Ce, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Li, Nb, B, or Ti with flux. The flux refers to a mixture of alkali metal haloids or alkali-earth metal haloids, including NaCl, KCl, and $Na_3AlF_6$.

(4) Refine the above-mentioned melt of alloy in the furnace; add a refining agent (chlorine, hexachloroethane, or manganese chloride etc. as refining agent, and boron salt as modifier, depending on the actual circumstance) into the melt of alloy; and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 538 MPa, elongation: 7.4%.

Example 17

Cu-5.1%; Characteristic Micro-alloying Elements—Li and Nb; Fundamental Micro-alloying RE Element—Eu (1) Weigh the required alloying elements according to the following formula calculation table.

| | Element | | | | | | | | | |
|---|---|---|---|---|---|---|---|---|---|---|
| | Al | Cu | Mn | Cd | Zr | Li | Nb | Ti | Eu | B |
| Mass (g) | 8836 | 510 | 70 | 30 | 50 | 180 | 60 | 50 | 200 | 14 |
| Total | 10000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Li, Al—Nb and Al—Zr (including salt compounds) in the proportions indicated in the formula, agitate to homogeneous state; then add pure metal of Cu and intermediate alloy or mixed metal additive of Al—Cd; next add B and RE element Eu, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Li, Nb, B, or Ti with flux. The flux refers to a mixture of alkali metal haloids or alkali-earth metal haloids, including NaCl, KCl, and $Na_3AlF_6$.

(4) Refine the above-mentioned melt of alloy in the furnace; add a refining agent (chlorine, hexachloroethane, or manganese chloride etc. as refining agent, and boron salt as modifier, depending on the actual circumstance) into the melt of alloy; and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 503 MPa, elongation: 6.1%.

Example 18

Cu-6.01%; Characteristic Micro-alloying Elements—Li and Nb; Fundamental Micro-alloying RE Elements—RE Mixture of La, Ce, and Pr (1) Weigh the required alloying elements according to the mix calculation table, as follows:

| | Element | | | | | | | | | |
|---|---|---|---|---|---|---|---|---|---|---|
| | Al | Cu | Mn | Cd | Zr | Li | Nb | Ti | RE mixture of La, Ce, and Pr | B |
| Mass (g) | 7099.2 | 480.8 | 64 | 24 | 64 | 80 | 64 | 32 | 80 | 12 |
| Total | 8000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Li, Al—Nb and Al—Zr (including salt compounds) in the proportions indicated in the formula, agitate to homogeneous state; then add pure metal of Cu and intermediate alloy or mixed metal additive of Al—Cd; next add B and RE Mixture of La, Ce, and Pr, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Li, Nb, B, or Ti with flux. The flux refers to a mixture of alkali metal haloids or alkali-earth metal haloids, including NaCl, KCl, and $Na_3AlF_6$.

(4) Refine the above-mentioned melt of alloy in the furnace; add a refining agent (chlorine, hexachloroethane, or manganese chloride etc. as refining agent, and boron salt as modifier, depending on the actual circumstance) into the melt of alloy; and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 533 MPa, elongation: 7.1%.

Example 19

Cu-6.5%; Characteristic Micro-alloying Elements—Li and Nb; Fundamental Micro-alloying RE Element—Er (1) Weigh the required alloying elements according to the following formula calculation table.

| | Element | | | | | | | | | |
|---|---|---|---|---|---|---|---|---|---|---|
| | Al | Cu | Mn | Cd | Zr | Li | Nb | Ti | Er | B |
| Mass (g) | 7163 | 520 | 50 | 32 | 40 | 40 | 80 | 28 | 40 | 7 |
| Total | 8000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Li, Al—Nb and Al—Zr (including salt compounds) in the proportions indicated in the formula, agitate to homogeneous state; then add pure metal of Cu and intermediate alloy or mixed metal additive of Al—Cd; next, add B and RE element Er, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Li, Nb, B, or Ti with flux. The flux refers to a mixture of alkali metal haloids or alkali-earth metal haloids, including NaCl, KCl, and $Na_3AlF_6$.

(4) Refine the above-mentioned melt of alloy in the furnace; add a refining agent (chlorine, hexachloroethane, or manganese chloride etc. as refining agent, and boron salt as modifier, depending on the actual circumstance) into the melt of alloy; and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 527 MPa, elongation: 6.9%.

Example 20

Cu-7%; Characteristic Micro-alloying Elements—Li and Nb; Fundamental Micro-alloying RE Element—Nd (1) Weigh the required alloying elements according to the following formula calculation table.

| | Element | | | | | | | | | |
|---|---|---|---|---|---|---|---|---|---|---|
| | Al | Cu | Mn | Cd | Zr | Li | Nb | Ti | Nd | B |
| Mass (g) | 10841 | 840 | 60 | 48 | 100 | 12 | 12 | 60 | 12 | 15 |
| Total | 12000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Li, Al—Nb and Al—Zr (including salt compounds) in the proportions indicated in the formula, agitate to homogeneous state; then add pure metal of Cu and intermediate alloy or mixed metal additive of Al—Cd; next add B and RE element Nd, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Li, Nb, B, or Ti with flux. The flux refers to a mixture of alkali metal haloids or alkali-earth metal haloids, including NaCl, KCl, and $Na_3AlF_6$.

(4) Refine the above-mentioned melt of alloy in the furnace; add a refining agent (chlorine, hexachloroethane, or manganese chloride etc. as refining agent, and boron salt as modifier, depending on the actual circumstance) into the melt of alloy; and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 517 MPa, elongation: 5.2%.

Example 21

Cu-8%; Characteristic Micro-alloying Elements—Li and Nb; Fundamental Micro-alloying RE Element—Ce (1) Weigh the required alloying elements according to the following formula calculation table.

| | Element | | | | | | | | | |
|---|---|---|---|---|---|---|---|---|---|---|
| | Al | Cu | Mn | Cd | Zr | Li | Nb | Ti | Ce | B |
| Mass (g) | 10671 | 960 | 72 | 60 | 96 | 15 | 15 | 60 | 36 | 15 |
| Total | 12000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Li, Al—Nb and Al—Zr (including salt compounds) in the proportions indicated in the formula, agitate to homogeneous state; then add pure metal of Cu and intermediate alloy or mixed metal additive of Al—Cd; next add B and RE element Ce, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Li, Nb, B, or Ti with flux. The flux refers to a mixture of alkali metal haloids or alkali-earth metal haloids, including NaCl, KCl, and $Na_3AlF_6$.

(4) Refine the above-mentioned melt of alloy in the furnace; add a refining agent (chlorine, hexachloroethane, or manganese chloride etc. as refining agent, and boron salt as modifier, depending on the actual circumstance) into the melt of alloy; and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 501 MPa, elongation: 4.8%.

Example 22

Cu-10%; Characteristic Micro-alloying Elements—Li and Nb; Fundamental Micro-alloying RE Element—Y (1) Weigh the required alloying elements according to the following formula calculation table.

| | Element | | | | | | | | | |
|---|---|---|---|---|---|---|---|---|---|---|
| | Al | Cu | Mn | Cd | Zr | Li | Nb | Ti | Y | B |
| Mass (g) | 10485 | 1200 | 60 | 48 | 72 | 18 | 18 | 60 | 24 | 15 |
| Total | 12000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Li, Al—Nb and Al—Zr (including salt compounds) in the proportions indicated in the formula, agitate to homogeneous state; then add pure metal of Cu and intermediate alloy or mixed metal additive of Al—Cd; next add B and RE element Y, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Li, Nb, B, or Ti with flux. The flux refers to a mixture of alkali metal haloids or alkali-earth metal haloids, including NaCl, KCl, and $Na_3AlF_6$.

(4) Refine the above-mentioned melt of alloy in the furnace; add a refining agent (chlorine, hexachloroethane, or manganese chloride etc. as refining agent, and boron salt as modifier, depending on the actual circumstance) into the melt of alloy; and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 487 MPa, elongation: 4.3%.

Example 23

Cu-1.0%; Characteristic Micro-alloying Elements—Mo and W; Fundamental Micro-alloying RE Element—La (1) Weigh the required alloying elements according to the following formula calculation table.

| | Element | | | | | | | | | |
|---|---|---|---|---|---|---|---|---|---|---|
| | Al | Cu | Mn | Cd | Zr | Mo | W | Ti | La | B |
| Mass (g) | 7076 | 80 | 120 | 36 | 80 | 80 | 80 | 40 | 400 | 8 |
| Total | 8000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Mo, Al—W and Al—Zr (including salt compounds) in the proportions indicated in the formula, agitate to homogeneous state; then add pure metal of Cu and intermediate alloy or mixed metal additive of Al—Cd; next add B and RE element La, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Mo, W, B, or Ti with flux. The flux refers to a mixture of alkali metal haloids or alkali-earth metal haloids, including NaCl, KCl, and $Na_3AlF_6$.

(4) Refine the above-mentioned melt of alloy in the furnace; add a refining agent (chlorine, hexachloroethane, or manganese chloride etc. as refining agent, and boron salt as modifier, depending on the actual circumstance) into the melt of alloy; and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 485 MPa, elongation: 7.5%.

Example 24

Cu-4.2%; Characteristic Micro-alloying Elements—Mo and W; Fundamental Micro-alloying RE Elements—RE Mixture of La and Ce (1) Weigh the required alloying elements according to the following formula calculation table.

| | Element | | | | | | | | | |
|---|---|---|---|---|---|---|---|---|---|---|
| | Al | Cu | Mn | Cd | Zr | Mo | W | Ti | RE mixture of La and Ce | B |
| Mass (g) | 7260 | 336 | 64 | 24 | 64 | 64 | 64 | 32 | 80 | 12 |
| Total | 8000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Mo, Al—W and Al—Zr (including salt compounds) in the proportions indicated in the formula, agitate to homogeneous state; then add pure metal of Cu and intermediate alloy or mixed metal additive of Al—Cd; next add B and RE Mixture of La and Ce, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Mo, W, B, or Ti with flux. The flux refers to a mixture of alkali metal haloids or alkali-earth metal haloids, including NaCl, KCl, and $Na_3AlF_6$.

(4) Refine the above-mentioned melt of alloy in the furnace; add a refining agent (chlorine, hexachloroethane, or manganese chloride etc. as refining agent, and boron salt as modifier, depending on the actual circumstance) into the melt of alloy; and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 538 MPa, elongation: 7.4%.

Example 25

Cu-5.1%; Characteristic Micro-alloying Elements—Mo and W; Fundamental Micro-alloying RE Element—Eu (1) Weigh the required alloying elements according to the following formula calculation table.

| | Element | | | | | | | | | |
|---|---|---|---|---|---|---|---|---|---|---|
| | Al | Cu | Mn | Cd | Zr | Mo | W | Ti | Eu | B |
| Mass (g) | 8956 | 510 | 70 | 30 | 50 | 60 | 60 | 50 | 200 | 14 |
| Total | 10000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Mo, Al—W and Al—Zr (including salt compounds) in the proportions indicated in the formula, agitate to homogeneous state; then add pure metal of Cu and intermediate alloy or mixed metal additive of Al—Cd; next add B and RE element Eu, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Mo, W, B, or Ti with flux. The flux refers to a mixture of alkali metal haloids or alkali-earth metal haloids, including NaCl, KCl, and $Na_3AlF_6$.

(4) Refine the above-mentioned melt of alloy in the furnace; add a refining agent (chlorine, hexachloroethane, or manganese chloride etc. as refining agent, and boron salt as modifier, depending on the actual circumstance) into the melt of alloy; and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 503 MPa, elongation: 6.1%.

Example 26

Cu-6.01%; Characteristic Micro-alloying Elements—Mo and W; Fundamental Micro-alloying RE Elements—RE Mixture of La, Ce, and Pr (1) Weigh the required alloying elements according to the mix calculation table, as follows:

| | Element | | | | | | | | | |
|---|---|---|---|---|---|---|---|---|---|---|
| | Al | Cu | Mn | Cd | Zr | Mo | W | Ti | RE mixture of La, Ce, and Pr | B |
| Mass (g) | 7115.2 | 480.8 | 64 | 24 | 64 | 64 | 64 | 32 | 80 | 12 |
| Total | 8000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Mo, Al—W and Al—Zr (including salt compounds) in the proportions indicated in the formula, agitate to homogeneous state; then add pure metal of Cu and intermediate alloy or mixed metal additive of Al—Cd; next add B and RE Mixture of La, Ce, and Pr, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Mo, W, B, or Ti with flux. The flux refers to a mixture of alkali metal haloids or alkali-earth metal haloids, including NaCl, KCl, and $Na_3AlF_6$.

(4) Refine the above-mentioned melt of alloy in the furnace; add a refining agent (chlorine, hexachloroethane, or manganese chloride etc. as refining agent, and boron salt as modifier, depending on the actual circumstance) into the melt of alloy; and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 533 MPa, elongation: 7.1%.

Example 27

Cu-6.5%; Characteristic Micro-alloying Elements—Mo and W; Fundamental Micro-alloying RE Element—Er (1) Weigh the required alloying elements according to the following formula calculation table.

| | Element | | | | | | | | | |
|---|---|---|---|---|---|---|---|---|---|---|
| | Al | Cu | Mn | Cd | Zr | Mo | W | Ti | Er | B |
| Mass (g) | 7123 | 520 | 50 | 32 | 40 | 80 | 80 | 28 | 40 | 7 |
| Total | 8000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Mo, Al—W and Al—Zr (including salt compounds) in the proportions indicated in the formula, agitate to homogeneous state; then add pure metal of Cu and intermediate alloy or mixed metal additive of Al—Cd; next add B and RE element Er, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Mo, W, B, or Ti with flux. The flux refers to a mixture of alkali metal haloids or alkali-earth metal haloids, including NaCl, KCl, and $Na_3AlF_6$.

(4) Refine the above-mentioned melt of alloy in the furnace; add a refining agent (chlorine, hexachloroethane, or manganese chloride etc. as refining agent, and boron salt as modifier, depending on the actual circumstance) into the melt of alloy; and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 527 MPa, elongation: 6.9%.

Example 28

Cu-7%; Characteristic Micro-alloying Elements—Mo and W; Fundamental Micro-alloying RE Element—Nd (1) Weigh the required alloying elements according to the following formula calculation table.

| | Element | | | | | | | | | |
|---|---|---|---|---|---|---|---|---|---|---|
| | Al | Cu | Mn | Cd | Zr | Mo | W | Ti | Nd | B |
| Mass (g) | 10841 | 840 | 60 | 48 | 100 | 12 | 12 | 60 | 12 | 15 |
| Total | 12000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Mo, Al—W and Al—Zr (including salt compounds) in the proportions indicated in the formula, agitate to homogeneous state; then add pure metal of Cu and intermediate alloy or mixed metal additive of Al—Cd; next add B and RE element Nd, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Mo, W, B, or Ti with flux. The flux refers to a mixture of alkali metal haloids or alkali-earth metal haloids, including NaCl, KCl, and $Na_3AlF_6$.

(4) Refine the above-mentioned melt of alloy in the furnace; add a refining agent (chlorine, hexachloroethane, or manganese chloride etc. as refining agent, and boron salt as modifier, depending on the actual circumstance) into the melt of alloy; and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 517 MPa, elongation: 5.2%.

Example 29

Cu-8%; Characteristic Micro-alloying Elements—Mo and W; Fundamental Micro-alloying RE Element—Ce (1) Weigh the required alloying elements according to the following formula calculation table.

| | Element | | | | | | | | | |
|---|---|---|---|---|---|---|---|---|---|---|
| | Al | Cu | Mn | Cd | Zr | Mo | W | Ti | Ce | B |
| Mass (g) | 10671 | 960 | 72 | 60 | 96 | 15 | 15 | 60 | 36 | 15 |
| Total | 12000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Mo, Al—W and Al—Zr (including salt compounds) in the proportions indicated in the formula, agitate to homogeneous state; then add pure metal of Cu and intermediate alloy or mixed metal additive of Al—Cd; next add B and RE element Ce, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Mo, W, B, or Ti with flux. The flux refers to a mixture of alkali metal haloids or alkali-earth metal haloids, including NaCl, KCl, and $Na_3AlF_6$.

(4) Refine the above-mentioned melt of alloy in the furnace; add a refining agent (chlorine, hexachloroethane, or manganese chloride etc. as refining agent, and boron salt as modifier, depending on the actual circumstance) into the melt of alloy; and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 501 MPa, elongation: 4.8%.

Example 30

Cu-10%; Characteristic Micro-alloying Elements—Mo and W; Fundamental Micro-alloying RE Element—Y (1) Weigh the required alloying elements according to the following formula calculation table.

| | Element | | | | | | | | | |
|---|---|---|---|---|---|---|---|---|---|---|
| | Al | Cu | Mn | Cd | Zr | Mo | W | Ti | Y | B |
| Mass (g) | 10485 | 1200 | 60 | 48 | 72 | 18 | 18 | 60 | 24 | 15 |
| Total | 12000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Mo, Al—W and Al—Zr (including salt compounds) in the proportions indicated in the formula, agitate to homogeneous state; then add pure metal of Cu and intermediate alloy or mixed metal additive of Al—Cd; next add B and RE element Y, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Mo, W, B, or Ti with flux. The flux refers to a mixture of alkali metal haloids or alkali-earth metal haloids, including NaCl, KCl, and $Na_3AlF_6$.

(4) Refine the above-mentioned melt of alloy in the furnace; add a refining agent (chlorine, hexachloroethane, or manganese chloride etc. as refining agent, and boron salt as modifier, depending on the actual circumstance) into the melt of alloy; and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 487 MPa, elongation: 4.3%.

Example 31

Cu-1.0%; Characteristic Micro-alloying Elements—Be, and Co; Fundamental Micro-alloying RE Element—La; High-Efficiency Modification Element—C (1) Weigh the required alloying elements according to the following formula calculation table.

| | Element | | | | | | | | | |
|---|---|---|---|---|---|---|---|---|---|---|
| | Al | Cu | Mn | Cd | Zr | Be | Co | Ti | La | C |
| Mass (g) | 7163.892 | 80 | 120 | 36 | 80 | 0.1 | 80 | 40 | 400 | 0.008 |
| Total | 8000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Be, Al—Co and Al—Zr (including salt compounds) in the proportions indicated in the formula, agitate to homogeneous state; then add pure metal of Cu and intermediate alloy or mixed metal additive of Al—Cd; next add C and RE element La, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Be, Co, or Ti with flux. The flux refers to a mixture of alkali metal haloids or alkali-earth metal haloids, including NaCl, KCl, and $Na_3AlF_6$. C refers to a compound or intermediate alloy of Al—C, including binary intermediate alloys, ternary intermediate alloys, and multi-element intermediate alloys.

(4) Refine the above-mentioned melt of alloy in the furnace; add a refining agent (chlorine, hexachloroethane, or manganese chloride etc. as refining agent, depending on the actual circumstance) into the melt of alloy, and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 485 MPa, elongation: 7.5%.

Example 32

Cu-4.2%; Characteristic Micro-alloying Elements—Be and Co; Fundamental Micro-alloying RE Elements—RE Mixture of La and Ce; High-Efficiency Modification Element—C (1) Weigh the required alloying elements according to the following formula calculation table.

| | Element | | | | | | | | | |
|---|---|---|---|---|---|---|---|---|---|---|
| | Al | Cu | Mn | Cd | Zr | Be | Co | Ti | RE mixture of La and Ce | C |
| Mass (g) | 7335.588 | 336 | 64 | 24 | 64 | 0.4 | 64 | 32 | 80 | 0.012 |
| Total | 8000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Be, Al—Co and Al—Zr (including salt compounds) in the proportions indicated in the formula, agitate to homogeneous state; then add pure metal of Cu and intermediate alloy or mixed metal additive of Al—Cd; next add C and RE Mixture of La and Ce, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Be, Co, or Ti with flux. The flux refers to a mixture of alkali metal haloids or alkali-earth metal haloids, including NaCl, KCl, and $Na_3AlF_6$. C refers to a compound or intermediate alloy of Al—C, including binary intermediate alloys, ternary intermediate alloys, and multi-element intermediate alloys.

(4) Refine the above-mentioned melt of alloy in the furnace; add a refining agent (chlorine, hexachloroethane, or manganese chloride etc. as refining agent, depending on the actual circumstance) into the melt of alloy, and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 538 MPa, elongation: 6.7%.

Example 33

Cu-5.1%; Characteristic Micro-alloying Elements—Be and Co; Fundamental Micro-alloying RE Element—Eu; High-Efficiency Modification Element—C (1) Weigh the required alloying elements according to the following formula calculation table.

| | Element | | | | | | | | | |
|---|---|---|---|---|---|---|---|---|---|---|
| | Al | Cu | Mn | Cd | Zr | Be | Co | Ti | Eu | B + C |
| Mass (g) | 9027.5 | 510 | 70 | 30 | 50 | 2 | 60 | 50 | 200 | 0.5 |
| Total | 10000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Be, Al—Co and Al—Zr (including salt compounds) in the proportions indicated in the formula, agitate to homogeneous state; then add pure metal of Cu and intermediate alloy or mixed metal additive of Al—Cd; next add B, C and RE element Eu, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Be, Co, B, C, or Ti with flux. The flux refers to a mixture of alkali metal haloids or alkali-earth metal haloids, including NaCl, KCl, and $Na_3AlF_6$. C refers to a compound or intermediate alloy of Al—C, including binary intermediate alloys, ternary intermediate alloys, and multi-element intermediate alloys.

(4) Refine the above-mentioned melt of alloy in the furnace; add a refining agent (chlorine, hexachloroethane, or manganese chloride etc. as refining agent, depending on the actual circumstance) into the melt of alloy, and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 503 MPa, elongation: 5.1%.

Example 34

Cu-6.01%; Characteristic Micro-alloying Elements—Be and Co; Fundamental Micro-alloying RE Elements—RE Mixture of La, Ce, and Pr; High-Efficiency Modification Element—C (1) Weigh the required alloying elements according to the following formula calculation table.

| | Element | | | | | | | | | |
|---|---|---|---|---|---|---|---|---|---|---|
| | Al | Cu | Mn | Cd | Zr | Be | Co | Ti | RE mixture of La, Ce, and Pr | B + C |
| Mass (g) | 7190 | 480.8 | 64 | 24 | 64 | 1 | 64 | 32 | 80 | 0.2 |
| Total | 8000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Be, Al—Co and Al—Zr (including salt compounds) in the proportions indicated in the formula, agitate to homogeneous state; then add pure metal of Cu and intermediate alloy or mixed metal additive of Al—Cd; next add B, C and RE element Eu, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Be, Co, B, C, or Ti with flux. The flux refers to a mixture of alkali metal haloids or alkali-earth metal haloids, including NaCl, KCl, and $Na_3AlF_6$. C refers to a compound or intermediate alloy of Al—C, including binary intermediate alloys, ternary intermediate alloys, and multi-element intermediate alloys.

(4) Refine the above-mentioned melt of alloy in the furnace; add a refining agent (chlorine, hexachloroethane, or manganese chloride etc. as refining agent, depending on the actual circumstance) into the melt of alloy, and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 533 MPa, elongation: 4.1%.

Example 35

Cu-6.5%; Characteristic Micro-alloying Elements—Be and Co; Fundamental Micro-alloying RE Element—Er; High-Efficiency Modification Element—C (1) Weigh the required alloying elements according to the following formula calculation table.

| | Element | | | | | | | | | |
|---|---|---|---|---|---|---|---|---|---|---|
| | Al | Cu | Mn | Cd | Zr | Be | Co | Ti | Er | B + C |
| Mass (g) | 7201 | 520 | 50 | 32 | 40 | 8 | 80 | 28 | 40 | 1 |
| Total | 8000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Be, Al—Co and Al—Zr (including salt compounds) in the proportions indicated in the formula, agitate to homogeneous state; then add pure metal of Cu and intermediate alloy or mixed metal additive of Al—Cd; next add B, C and RE element Eu, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Be, Co, B, C, or Ti with flux. The flux refers to a mixture of alkali metal haloids or alkali-earth metal haloids, including NaCl, KCl, and $Na_3AlF_6$. C refers to a compound or intermediate alloy of Al—C, including binary intermediate alloys, ternary intermediate alloys, and multi-element intermediate alloys.

(4) Refine the above-mentioned melt of alloy in the furnace; add a refining agent (chlorine, hexachloroethane, or manganese chloride etc. as refining agent, depending on the actual circumstance) into the melt of alloy, and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 527 MPa, elongation: 6.9%.

Example 36

Cu-7%; Characteristic Micro-alloying Elements—Be and Co; Fundamental Micro-alloying RE Element—Nd; High-Efficiency Modification Element—C (1) Weigh the required alloying elements according to the following formula calculation table.

| | Element | | | | | | | | | |
|---|---|---|---|---|---|---|---|---|---|---|
| | Al | Cu | Mn | Cd | Zr | Be | Co | Ti | Nd | B + C |
| Mass (g) | 10850 | 840 | 60 | 48 | 100 | 6 | 12 | 60 | 12 | 12 |
| Total | 12000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Be, Al—Co and Al—Zr (including salt compounds) in the proportions indicated in the formula, agitate to homogeneous state; then add pure metal of Cu and intermediate alloy or mixed metal additive of Al—Cd; next add B, C and RE element Eu, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Be, Co, B, C, or Ti with flux. The flux refers to a mixture of alkali metal haloids or alkali-earth metal haloids, including NaCl, KCl, and $Na_3AlF_6$. C refers to a compound or intermediate alloy of Al—C, including binary intermediate alloys, ternary intermediate alloys, and multi-element intermediate alloys.

(4) Refine the above-mentioned melt of alloy in the furnace; add a refining agent (chlorine, hexachloroethane, or manganese chloride etc. as refining agent, depending on the actual circumstance) into the melt of alloy, and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 517 MPa, elongation: 5.3%.

Example 37

Cu-8%; Characteristic Micro-alloying Elements—Be and Co; Fundamental Micro-alloying RE Element—Ce; High-Efficiency Modification Element—C (1) Weigh the required alloying elements according to the following formula calculation table.

| | Element | | | | | | | | | |
|---|---|---|---|---|---|---|---|---|---|---|
| | Al | Cu | Mn | Cd | Zr | Be | Co | Ti | Ce | B + C |
| Mass (g) | 10690 | 960 | 72 | 60 | 96 | 5 | 15 | 60 | 36 | 6 |
| Total | 12000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Be, Al—Co and Al—Zr (including salt compounds) in the proportions indicated in the formula, agitate to homogeneous state; then add pure metal of Cu and intermediate alloy or mixed metal additive of Al—Cd; next add B, C and RE element Eu, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Be, Co, B, C, or Ti with flux. The flux refers to a mixture of alkali metal haloids or alkali-earth metal haloids, including NaCl, KCl, and $Na_3AlF_6$. C refers to a compound or intermediate alloy of Al—C, including binary intermediate alloys, ternary intermediate alloys, and multi-element intermediate alloys.

(4) Refine the above-mentioned melt of alloy in the furnace; add a refining agent (chlorine, hexachloroethane, or manganese chloride etc. as refining agent, depending on the actual circumstance) into the melt of alloy, and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 501 MPa, elongation: 4.8%.

Example 38

Cu-10%; Characteristic Micro-alloying Elements—Be and Co; Fundamental Micro-alloying RE Element—Y; High-Efficiency Modification Element—C (1) Weigh the required alloying elements according to the following formula calculation table.

| | Element | | | | | | | | | |
|---|---|---|---|---|---|---|---|---|---|---|
| | Al | Cu | Mn | Cd | Zr | Be | Co | Ti | Y | B + C |
| Mass (g) | 10492 | 1200 | 60 | 48 | 72 | 8 | 18 | 60 | 24 | 18 |
| Total | 12000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Be, Al—Co and Al—Zr (including salt compounds) in the proportions indicated in the formula, agitate to homogeneous state; then add pure metal of Cu and intermediate alloy or mixed metal additive of Al—Cd; next add B, C and RE element Eu, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Be, Co, B, C, or Ti with flux. The flux refers to a mixture of alkali metal haloids or alkali-earth metal haloids, including NaCl, KCl, and $Na_3AlF_6$. C refers to a compound or Al—C intermediate alloy, including binary intermediate alloys, ternary intermediate alloys, and multi-element intermediate alloys.

(4) Refine the above-mentioned melt of alloy in the furnace; add a refining agent (chlorine, hexachloroethane, or manganese chloride etc. as refining agent, depending on the actual circumstance) into the melt of alloy, and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 487 MPa, elongation: 3.9%.

Example 39

Cu-1.0%; Characteristic Micro-alloying Elements—Mo and Ni; Fundamental Micro-alloying RE Element—La; High-Efficiency Modification Element—C (1) Weigh the required alloying elements according to the following formula calculation table.

| | Element | | | | | | | | | |
|---|---|---|---|---|---|---|---|---|---|---|
| | Al | Cu | Mn | Cd | Zr | Mo | Ni | Ti | La | C |
| Mass (g) | 7083.992 | 80 | 120 | 36 | 80 | 80 | 80 | 40 | 400 | 0.008 |
| Total | 8000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Mo, Al—Ni and Al—Zr (including salt compounds) in the proportions indicated in the formula, agitate to homogeneous state; then add pure metal of Cu and intermediate alloy or mixed metal additive of Al—Cd; next add C and RE element La, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Mo, Ni, or Ti with flux. The flux refers to a mixture of alkali metal haloids or alkali-earth metal haloids, including NaCl, KCl, and $Na_3AlF_6$. C refers to a compound or intermediate alloy of Al—C, including binary intermediate alloys, ternary intermediate alloys, and multi-element intermediate alloys.

(4) Refine the above-mentioned melt of alloy in the furnace; add a refining agent (chlorine, hexachloroethane, or manganese chloride etc. as refining agent, depending on the actual circumstance) into the melt of alloy, and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 485 MPa, elongation: 7.5%.

Example 40

Cu-4.2%; Characteristic Micro-alloying Elements—Mo and Ni; Fundamental Micro-alloying RE Elements—RE Mixture of La and Ce; High-Efficiency Modification Element—C (1) Weigh the required alloying elements according to the following formula calculation table.

| | Element | | | | | | | | | |
|---|---|---|---|---|---|---|---|---|---|---|
| | Al | Cu | Mn | Cd | Zr | Mo | Bi | Ti | RE mixture of La and Ce | C |
| Mass (g) | 7271.988 | 336 | 64 | 24 | 64 | 64 | 64 | 32 | 80 | 0.012 |
| Total | 8000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Mo, Al—Ni and Al—Zr (including salt compounds) in the proportions indicated in the formula, agitate to homogeneous state; then add pure metal of Cu and intermediate alloy or mixed metal additive of Al—Cd; next add C and RE Mixture of La and Ce, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Mo, Ni, or Ti with flux. The flux refers to a mixture of alkali metal haloids or alkali-earth metal haloids, including NaCl, KCl, and $Na_3AlF_6$. C refers to a compound or intermediate alloy of Al—C, including binary intermediate alloys, ternary intermediate alloys, and multi-element intermediate alloys.

(4) Refine the above-mentioned melt of alloy in the furnace; add a refining agent (chlorine, hexachloroethane, or manganese chloride etc. as refining agent, depending on the actual circumstance) into the melt of alloy, and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 538 MPa, elongation: 6.7%.

Example 41

Cu-5.1%; Characteristic Micro-alloying Elements—Mo and Ni; Fundamental Micro-alloying RE Element—Eu; High-Efficiency Modification Element—C (1) Weigh the required alloying elements according to the following formula calculation table.

| | Element | | | | | | | | | |
|---|---|---|---|---|---|---|---|---|---|---|
| | Al | Cu | Mn | Cd | Zr | Mo | Ni | Ti | Eu | B + C |
| Mass (g) | 8969.5 | 510 | 70 | 30 | 50 | 60 | 60 | 50 | 200 | 0.5 |
| Total | 10000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Mo, Al—Ni and Al—Zr (including salt compounds) in the proportions indicated in the formula, agitate to homogeneous state; then add pure metal of Cu and intermediate alloy or mixed metal additive of Al—Cd; next add B, C and RE element Ce, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Mo, Ni, B, C, or Ti with flux. The flux refers to a mixture of alkali metal haloids or alkali-earth metal haloids, including NaCl, KCl, and $Na_3AlF_6$. C refers to a compound or intermediate alloy of Al—C, including binary intermediate alloys, ternary intermediate alloys, and multi-element intermediate alloys.

(4) Refine the above-mentioned melt of alloy in the furnace; add a refining agent (chlorine, hexachloroethane, or manganese chloride etc. as refining agent, depending on the actual circumstance) into the melt of alloy, and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 503 MPa, elongation: 5.1%.

Example 42

Cu-6.01%; Characteristic Micro-alloying Elements—Mo and Ni; Fundamental Micro-alloying RE Elements—RE Mixture of La, Ce, and Pr; High-Efficiency Modification Element—C (1) Weigh the required alloying elements according to the following formula calculation table.

| | Element | | | | | | | | | |
|---|---|---|---|---|---|---|---|---|---|---|
| | Al | Cu | Mn | Cd | Zr | Mo | Ni | Ti | RE mixture La, Ce, and Pr | B + C |
| Weight (g) | 7127 | 480.8 | 64 | 24 | 64 | 64 | 64 | 32 | 80 | 0.2 |
| Total | 8000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Mo, Al—Ni and Al—Zr (including salt compounds) in the proportions indicated in the formula, agitate to homogeneous state; then add pure metal of Cu and intermediate alloy or mixed metal additive of Al—Cd; next add B, C and RE element Ce, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Mo, Ni, B, C, or Ti with flux. The flux refers to a mixture of alkali metal haloids or alkali-earth metal haloids, including NaCl, KCl, and $Na_3AlF_6$. C refers to a compound or intermediate alloy of Al—C, including binary intermediate alloys, ternary intermediate alloys, and multi-element intermediate alloys.

(4) Refine the above-mentioned melt of alloy in the furnace; add a refining agent (chlorine, hexachloroethane, or manganese chloride etc. as refining agent, depending on the actual circumstance) into the melt of alloy, and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 533 MPa, elongation: 4.1%.

Example 43

Cu-6.5%; Characteristic Micro-alloying Elements—Mo and Ni; Fundamental Micro-alloying RE Element—Er; High-Efficiency Modification Element—C (1) Weigh the required alloying elements according to the following formula calculation table.

| | Element | | | | | | | | | |
|---|---|---|---|---|---|---|---|---|---|---|
| | Al | Cu | Mn | Cd | Zr | Mo | Ni | Ti | Er | B + C |
| Mass (g) | 7129 | 520 | 50 | 32 | 40 | 80 | 80 | 28 | 40 | 1 |
| Total | 8000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Mo, Al—Ni and Al—Zr (including salt compounds) in the proportions indicated in the formula, agitate to homogeneous state; then add pure metal of Cu and intermediate alloy or mixed metal additive of Al—Cd; next add B, C and RE element Ce, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Mo, Ni, B, C, or Ti with flux. The flux refers to a mixture of alkali metal haloids or alkali-earth metal haloids, including NaCl, KCl, and $Na_3AlF_6$. C refers to a compound or intermediate alloy of Al—C, including binary intermediate alloys, ternary intermediate alloys, and multi-element intermediate alloys.

(4) Refine the above-mentioned melt of alloy in the furnace; add a refining agent (chlorine, hexachloroethane, or manganese chloride etc. as refining agent, depending on the actual circumstance) into the melt of alloy, and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 527 MPa, elongation: 6.9%.

Example 44

Cu-7%; Characteristic Micro-alloying Elements—Mo and Ni; Fundamental Micro-alloying RE Elements—Nd; High-Efficiency Modification Element—C (1) Weigh the required alloying elements according to the following formula calculation table.

| | Element | | | | | | | | | |
|---|---|---|---|---|---|---|---|---|---|---|
| | Al | Cu | Mn | Cd | Zr | Mo | Ni | Ti | Nd | B + C |
| Mass (g) | 10844 | 840 | 60 | 48 | 100 | 12 | 12 | 60 | 12 | 12 |
| Total | 12000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Mo, Al—Ni and Al—Zr (including salt compounds) in the proportions indicated in the formula, agitate to homogeneous state; then add pure metal of Cu and intermediate alloy or mixed metal additive of Al—Cd; next add B, C and RE element Ce, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Mo, Ni, B, C, or Ti with flux. The flux refers to a mixture of alkali metal haloids or alkali-earth metal haloids, including NaCl, KCl, and $Na_3AlF_6$. C refers to a compound or Al—C intermediate alloy, including binary intermediate alloys, ternary intermediate alloys, and multi-element intermediate alloys.

(4) Refine the above-mentioned melt of alloy in the furnace; add a refining agent (chlorine, hexachloroethane, or manganese chloride etc. as refining agent, depending on the actual circumstance) into the melt of alloy, and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 517 MPa, elongation: 5.3%.

Example 45

Cu-8%; Characteristic Micro-alloying Elements—Mo and Ni; Fundamental Micro-alloying RE Element—Ce; High-Efficiency Modification Element—C (1) Weigh the required alloying elements according to the following formula calculation table.

| | Element | | | | | | | | | |
|---|---|---|---|---|---|---|---|---|---|---|
| | Al | Cu | Mn | Cd | Zr | Mo | Ni | Ti | Ce | B + C |
| Mass (g) | 10680 | 960 | 72 | 60 | 96 | 15 | 15 | 60 | 36 | 6 |
| Total | 12000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Mo, Al—Ni and Al—Zr (including salt compounds) in the proportions indicated in the formula, agitate to homogeneous state; then add pure metal of Cu and intermediate alloy or mixed metal additive of Al—Cd; next add B, C and RE element Ce, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Mo, Ni, B, C, or Ti with flux. The flux refers to a mixture of alkali metal haloids or alkali-earth metal haloids, including NaCl, KCl, and $Na_3AlF_6$. C refers to a compound or intermediate alloy of Al—C, including binary intermediate alloys, ternary intermediate alloys, and multi-element intermediate alloys.

(4) Refine the above-mentioned melt of alloy in the furnace; add a refining agent (chlorine, hexachloroethane, or manganese chloride etc. as refining agent, depending on the actual circumstance) into the melt of alloy, and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 501 MPa, elongation: 4.8%.

Example 46

Cu-10%; Characteristic Micro-alloying Elements—Mo and Ni; Fundamental Micro-alloying RE Element—Y; High-Efficiency Modification Element—C (1) Weigh the required alloying elements according to the following formula calculation table.

| | Element | | | | | | | | | |
|---|---|---|---|---|---|---|---|---|---|---|
| | Al | Cu | Mn | Cd | Zr | Mo | Ni | Ti | Y | B + C |
| Mass (g) | 10482 | 1200 | 60 | 48 | 72 | 18 | 18 | 60 | 24 | 18 |
| Total | 12000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Mo, Al—Ni and Al—Zr (including salt compounds) in the proportions indicated in the formula, agitate to homogeneous state; then add pure metal of Cu and intermediate alloy or mixed metal additive of Al—Cd; next add B, C and RE element Ce, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Mo, Ni, B, C, or Ti with flux. The flux refers to a mixture of alkali metal haloids or alkali-earth metal haloids, including NaCl, KCl, and $Na_3AlF_6$. C refers to a compound or intermediate alloy of Al—C, including binary intermediate alloys, ternary intermediate alloys, and multi-element intermediate alloys.

(4) Refine the above-mentioned melt of alloy in the furnace; add a refining agent (chlorine, hexachloroethane, or manganese chloride etc. as refining agent, depending on the actual circumstance) into the melt of alloy, and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 487 MPa, elongation: 3.9%.

Example 47

Cu-1.0%; Characteristic Micro-alloying Elements—Cr and Nb; Fundamental Micro-alloying RE Element—La; High-Efficiency Modification Element—C (1) Weigh the required alloying elements according to the following formula calculation table.

| | Element | | | | | | | | | |
|---|---|---|---|---|---|---|---|---|---|---|
| | Al | Cu | Mn | Cd | Zr | Cr | Nb | Ti | La | C |
| Mass (g) | 7083.992 | 80 | 120 | 36 | 80 | 80 | 80 | 40 | 400 | 0.008 |
| Total | 8000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Cr, Al—Nb and Al—Zr (including salt compounds) in the proportions indicated in the formula, agitate to homogeneous state; then add pure metal of Cu and intermediate alloy or mixed metal additive of Al—Cd; next add C and RE element La, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Cr, Nb, or Ti with flux. The flux refers to a mixture of alkali metal haloids or alkali-earth metal haloids, including NaCl, KCl, and $Na_3AlF_6$. C refers to a compound or Al—C intermediate alloy, including binary intermediate alloys, ternary intermediate alloys, and multi-element intermediate alloys.

(4) Refine the above-mentioned melt of alloy in the furnace; add a refining agent (chlorine, hexachloroethane, or manganese chloride etc. as refining agent, depending on the actual circumstance) into the melt of alloy, and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 485 MPa, elongation: 7.5%.

Example 48

Cu-4.2%; Characteristic Micro-alloying Elements—Cr and Nb; Fundamental Micro-alloying RE Elements—RE Mixture of La and Ce; High-Efficiency Modification Element—C (1) Weigh the required alloying elements according to the following formula calculation table.

| | Element | | | | | | | | | |
|---|---|---|---|---|---|---|---|---|---|---|
| | Al | Cu | Mn | Cd | Zr | Cr | Nb | Ti | RE mixture of La and Ce | C |
| Mass (g) | 7271.988 | 336 | 64 | 24 | 64 | 64 | 64 | 32 | 80 | 0.012 |
| Total | 8000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Cr, Al—Nb and Al—Zr (including salt compounds) in the proportions indicated in the formula, agitate to homogeneous state; then add pure metal of Cu and intermediate alloy or mixed metal additive of Al—Cd; next add C and RE Mixture of La and Ce, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Cr, Nb, or Ti with flux. The flux refers to a mixture of alkali metal haloids or alkali-earth metal haloids, including NaCl, KCl, and $Na_3AlF_6$. C refers to a compound or intermediate alloy of Al—C, including binary intermediate alloys, ternary intermediate alloys, and multi-element intermediate alloys.

(4) Refine the above-mentioned melt of alloy in the furnace; add a refining agent (chlorine, hexachloroethane, or manganese chloride etc. as refining agent, depending on the actual circumstance) into the melt of alloy, and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 538 MPa, elongation: 6.7%.

Example 49

Cu-5.1%; Characteristic Micro-alloying Elements—Cr and Nb; Fundamental Micro-alloying RE Element—Eu; High-Efficiency Modification Element—C (1) Weigh the required alloying elements according to the following formula calculation table.

| | Element | | | | | | | | | |
|---|---|---|---|---|---|---|---|---|---|---|
| | Al | Cu | Mn | Cd | Zr | Cr | Nb | Ti | Eu | B + C |
| Mass (g) | 8969.5 | 510 | 70 | 30 | 50 | 60 | 60 | 50 | 200 | 0.5 |
| Total | 10000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Cr, Al—Nb and Al—Zr (including salt compounds) in the proportions indicated in the formula, agitate to homogeneous state; then add pure metal of Cu and intermediate alloy or mixed metal additive of Al—Cd; next add B, C and RE element Y, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Cr, Nb, B, C, or Ti with flux. The flux refers to a mixture of alkali metal haloids or alkali-earth metal haloids, including NaCl, KCl, and $Na_3AlF_6$. C refers to a compound or intermediate alloy of Al—C, including binary intermediate alloys, ternary intermediate alloys, and multi-element intermediate alloys.

(4) Refine the above-mentioned melt of alloy in the furnace; add a refining agent (chlorine, hexachloroethane, or manganese chloride etc. as refining agent, depending on the actual circumstance) into the melt of alloy, and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 503 MPa, elongation: 5.1%.

Example 50

Cu-6.01%; Characteristic Micro-alloying Elements—Cr and Nb; Fundamental Micro-alloying RE Elements—RE Mixture of La, Ce, and Pr; High-Efficiency Modification Element—C (1) Weigh the required alloying elements according to the following formula calculation table.

| | Element | | | | | | | | | |
|---|---|---|---|---|---|---|---|---|---|---|
| | Al | Cu | Mn | Cd | Zr | Cr | Nb | Ti | RE mixture of La, Ce, and Pr | B + C |
| Weight (g) | 7127 | 480.8 | 64 | 24 | 64 | 64 | 64 | 32 | 80 | 0.2 |
| Total | 8000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Cr, Al—Nb and Al—Zr (including salt compounds) in the proportions indicated in the formula, agitate to homogeneous state; then add pure metal of Cu and intermediate alloy or mixed metal additive of Al—Cd; next add B, C and RE element Y, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Cr, Nb, B, C, or Ti with flux. The flux refers to a mixture of alkali metal haloids or alkali-earth metal haloids, including NaCl, KCl, and $Na_3AlF_6$. C refers to a compound or intermediate alloy of Al—C, including binary intermediate alloys, ternary intermediate alloys, and multi-element intermediate alloys.

(4) Refine the above-mentioned melt of alloy in the furnace; add a refining agent (chlorine, hexachloroethane, or manganese chloride etc. as refining agent, depending on the actual circumstance) into the melt of alloy, and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 533 MPa, elongation: 4.1%.

Example 51

Cu-6.5%; Characteristic Micro-alloying Elements—Cr and Nb; Fundamental Micro-alloying RE Element—Er; High-Efficiency Modification Element—C (1) Weigh the required alloying elements according to the following formula calculation table.

| | Element | | | | | | | | | |
|---|---|---|---|---|---|---|---|---|---|---|
| | Al | Cu | Mn | Cd | Zr | Cr | Nb | Ti | Er | B + C |
| Mass (g) | 7129 | 520 | 50 | 32 | 40 | 80 | 80 | 28 | 40 | 1 |
| Total | 8000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Cr, Al—Nb and Al—Zr (including salt compounds) in the proportions indicated in the formula, agitate to homogeneous state; then add pure metal of Cu and intermediate alloy or mixed metal additive of Al—Cd; next add B, C and RE element Y, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Cr, Nb, B, C, or Ti with flux. The flux refers to a mixture of alkali metal haloids or alkali-earth metal haloids, including NaCl, KCl, and $Na_3AlF_6$. C refers to a compound or intermediate alloy of Al—C, including binary intermediate alloys, ternary intermediate alloys, and multi-element intermediate alloys.

(4) Refine the above-mentioned melt of alloy in the furnace; add a refining agent (chlorine, hexachloroethane, or manganese chloride etc. as refining agent, depending on the actual circumstance) into the melt of alloy, and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 527 MPa, elongation: 6.9%.

Example 52

Cu-7%; Characteristic Micro-alloying Elements—Cr and Nb; Fundamental Micro-alloying RE Element—Nd; High-Efficiency Modification Element—C (1) Weigh the required alloying elements according to the following formula calculation table.

| | Element | | | | | | | | | |
|---|---|---|---|---|---|---|---|---|---|---|
| | Al | Cu | Mn | Cd | Zr | Cr | Nb | Ti | Nd | B + C |
| Mass (g) | 10844 | 840 | 60 | 48 | 100 | 12 | 12 | 60 | 12 | 12 |
| Total | 12000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Cr, Al—Nb and Al—Zr (including salt compounds) in the proportions indicated in the formula, agitate to homogeneous state; then add pure metal of Cu and intermediate alloy or mixed metal additive of Al—Cd; next add B, C and RE element Y, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Cr, Nb, B, C, or Ti with flux. The flux refers to a mixture of alkali metal haloids or alkali-earth metal haloids, including NaCl, KCl, and $Na_3AlF_6$. C refers to a compound or intermediate alloy of Al—C, including binary intermediate alloys, ternary intermediate alloys, and multi-element intermediate alloys.

(4) Refine the above-mentioned melt of alloy in the furnace; add a refining agent (chlorine, hexachloroethane, or manganese chloride etc. as refining agent, depending on the actual circumstance) into the melt of alloy, and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 517 MPa, elongation: 5.3%.

Example 53

Cu-8%; Characteristic Micro-alloying Elements—Cr and Nb; Fundamental Micro-alloying RE Element—Ce; High-Efficiency Modification Element—C (1) Weigh the required alloying elements according to the following formula calculation table.

| | Element | | | | | | | | | |
|---|---|---|---|---|---|---|---|---|---|---|
| | Al | Cu | Mn | Cd | Zr | Cr | Nb | Ti | Ce | B + C |
| Mass (g) | 10680 | 960 | 72 | 60 | 96 | 15 | 15 | 60 | 36 | 6 |
| Total | 12000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Cr, Al—Nb and Al—Zr (including salt compounds) in the proportions indicated in the formula, agitate to homogeneous state; then add pure metal of Cu and intermediate alloy or mixed metal additive of Al—Cd; next add B, C and RE element Y, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Cr, Nb, B, C, or Ti with flux. The flux refers to a mixture of alkali metal haloids or alkali-earth metal haloids, including NaCl, KCl, and $Na_3AlF_6$. C refers to a compound or intermediate alloy of Al—C, including binary intermediate alloys, ternary intermediate alloys, and multi-element intermediate alloys.

(4) Refine the above-mentioned melt of alloy in the furnace; add a refining agent (chlorine, hexachloroethane, or manganese chloride etc. as refining agent, depending on the actual circumstance) into the melt of alloy, and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 501 MPa, elongation: 4.8%.

Example 54

Cu-10%; Characteristic Micro-alloying Elements—Cr and Nb; Fundamental Micro-alloying RE Element—Y; High-Efficiency Modification Element—C (1) Weigh the required alloying elements according to the following formula calculation table.

| | Element | | | | | | | | | |
|---|---|---|---|---|---|---|---|---|---|---|
| | Al | Cu | Mn | Cd | Zr | Cr | Nb | Ti | Y | B + C |
| Mass (g) | 10482 | 1200 | 60 | 48 | 72 | 18 | 18 | 60 | 24 | 18 |
| Total | 12000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Cr, Al—Nb and Al—Zr (including salt compounds) in the proportions indicated in the formula, agitate to homogeneous state; then add pure metal of Cu and intermediate alloy or mixed metal additive of Al—Cd; next add B, C and RE element Y, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Cr, Nb, B, C, or Ti with flux. The flux refers to a mixture of alkali metal haloids or alkali-earth metal haloids, including NaCl, KCl, and $Na_3AlF_6$. C refers to a compound or intermediate alloy of Al—C, including binary intermediate alloys, ternary intermediate alloys, and multi-element intermediate alloys.

(4) Refine the above-mentioned melt of alloy in the furnace; add a refining agent (chlorine, hexachloroethane, or manganese chloride etc. as refining agent, depending on the actual circumstance) into the melt of alloy, and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 487 MPa, elongation: 3.9%.

Example 55

Cu-1.0%; Characteristic Micro-alloying Elements—Li and W; Fundamental Micro-alloying RE Element—La; High-Efficiency Modification Element—C (1) Weigh the required alloying elements according to the mix calculation table, as follows:

| | Element | | | | | | | | | |
|---|---|---|---|---|---|---|---|---|---|---|
| | Al | Cu | Mn | Cd | Zr | Li | W | Ti | La | C |
| Mass (g) | 7083.992 | 80 | 120 | 36 | 80 | 80 | 80 | 40 | 400 | 0.008 |
| Total | 8000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives Al—Mn, Al—Ti, Al—Li, Al—W and Al—Zr (including salt compounds) in the proportions indicated in the formula, agitate to homogeneous state; then add pure metal of Cu and intermediate alloy or mixed metal additive of Al—Cd; next add C and RE element La, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Li, W, or Ti with flux. The flux refers to a mixture of alkali metal haloids or alkali-earth metal haloids, including NaCl, KCl, and $Na_3AlF_6$. C refers to a compound or intermediate alloy of Al—C, including binary intermediate alloys, ternary intermediate alloys, and multi-element intermediate alloys.

(4) Refine the above-mentioned melt of alloy in the furnace; add a refining agent (chlorine, hexachloroethane, or manganese chloride etc. as refining agent, depending on the actual circumstance) into the melt of alloy, and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 485 MPa, elongation: 7.5%.

Example 56

Cu-4.2%; Characteristic Micro-alloying Elements—Li and W; Fundamental Micro-alloying RE Elements—RE Mixture of La and Ce; High-Efficiency Modification Element—C (1) Weigh the required alloying elements according to the following formula calculation table.

| | Element | | | | | | | | | |
|---|---|---|---|---|---|---|---|---|---|---|
| | Al | Cu | Mn | Cd | Zr | Li | W | Ti | RE mixture of La and Ce | C |
| Mass (g) | 7327.88 | 336 | 64 | 24 | 64 | 8 | 64 | 32 | 80 | 0.12 |
| Total | 8000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Li, Al—W and Al—Zr (including salt compounds) in the proportions indicated in the formula, agitate to homogeneous state; then add pure metal of Cu and intermediate alloy or mixed metal additive of Al—Cd; next add C and RE Mixture of La and Ce, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Li, W, or Ti with flux. The flux refers to a mixture of alkali metal haloids or alkali-earth metal haloids, including NaCl, KCl, and $Na_3AlF_6$. C refers to a compound or intermediate alloy of Al—C, including binary intermediate alloys, ternary intermediate alloys, and multi-element intermediate alloys.

(4) Refine the above-mentioned melt of alloy in the furnace; add a refining agent (chlorine, hexachloroethane, or manganese chloride etc. as refining agent, depending on the actual circumstance) into the melt of alloy, and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 538 MPa, elongation: 7.4%.

Example 57

Cu-5.1%; Characteristic Micro-alloying Elements—Li and W; Fundamental Micro-alloying RE Element—Eu; High-Efficiency Modification Element—C (1) Weigh the required alloying elements according to the following formula calculation table.

| | Element | | | | | | | | | |
|---|---|---|---|---|---|---|---|---|---|---|
| | Al | Cu | Mn | Cd | Zr | Li | W | Ti | Eu | C |
| Mass (g) | 8849.85 | 510 | 70 | 30 | 50 | 180 | 60 | 50 | 200 | 0.15 |
| Total | 10000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Li, Al—W and Al—Zr (including salt compounds) in the proportions indicated in the formula, agitate to homogeneous state; then add pure metal of Cu and intermediate alloy or mixed metal additive of Al—Cd; next add C and RE element Eu, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Li, W, or Ti with flux. The flux refers to a mixture of alkali metal haloids or alkali-earth metal haloids, including NaCl, KCl, and $Na_3AlF_6$. C refers to a compound or intermediate alloy of Al—C, including binary intermediate alloys, ternary intermediate alloys, and multi-element intermediate alloys.

(4) Refine the above-mentioned melt of alloy in the furnace; add a refining agent (chlorine, hexachloroethane, or manganese chloride etc. as refining agent, depending on the actual circumstance) into the melt of alloy, and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 503 MPa, elongation: 6.1%.

Example 58

Cu-6.01%; Characteristic Micro-alloying Elements—Li and W; Fundamental Micro-alloying RE Elements—RE Mixture of La, Ce, and Pr; High-Efficiency Modification Element—C (1) Weigh the required alloying elements according to the following formula calculation table.

| | Element | | | | | | | | | |
|---|---|---|---|---|---|---|---|---|---|---|
| | Al | Cu | Mn | Cd | Zr | Li | W | Ti | RE mixture of La, Ce, and Pr | C |
| Mass (g) | 7111 | 480.8 | 64 | 24 | 64 | 80 | 64 | 32 | 80 | 0.2 |
| Total | 8000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Li, Al—W and Al—Zr (including salt compounds) in the proportions indicated in the formula, agitate to homogeneous state; then add pure metal of Cu and intermediate alloy or mixed metal additive of Al—Cd; next add C and RE Mixture of La, Ce, and Pr, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Li, W, or Ti with flux. The flux refers to a mixture of alkali metal haloids or alkali-earth metal haloids, including NaCl, KCl, and $Na_3AlF_6$. C refers to a compound or intermediate alloy of Al—C, including binary intermediate alloys, ternary intermediate alloys, and multi-element intermediate alloys.

(4) Refine the above-mentioned melt of alloy in the furnace; add a refining agent (chlorine, hexachloroethane, or manganese chloride etc. as refining agent, depending on the actual circumstance) into the melt of alloy, and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 533 MPa, elongation: 7.1%.

Example 59

Cu-6.5%; Characteristic Micro-alloying Elements—Li and W; Fundamental Micro-alloying RE Element—Er; High-Efficiency Modification Element—C (1) Weigh the required alloying elements according to the following formula calculation table.

| | Element | | | | | | | | | |
|---|---|---|---|---|---|---|---|---|---|---|
| | Al | Cu | Mn | Cd | Zr | Li | W | Ti | Er | B + C |
| Mass (g) | 7169.7 | 520 | 50 | 32 | 40 | 40 | 80 | 28 | 40 | 0.3 |
| Total | 8000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Li, Al—W and Al—Zr (including salt compounds) in the proportions indicated in the formula, agitate to homogeneous state; then add pure metal of Cu and intermediate alloy or mixed metal additive of Al—Cd; next add B, C, and RE element Er, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Li, W, B, C, or Ti with flux. The flux refers to a mixture of alkali metal haloids or alkali-earth metal haloids, including NaCl, KCl, and $Na_3AlF_6$. C refers to a compound or intermediate alloy of Al—C, including binary intermediate alloys, ternary intermediate alloys, and multi-element intermediate alloys.

(4) Refine the above-mentioned melt of alloy in the furnace; add a refining agent (chlorine, hexachloroethane, or manganese chloride etc. as refining agent, depending on the actual circumstance) into the melt of alloy, and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 527 MPa, elongation: 6.9%.

Example 60

Cu-7%; Characteristic Micro-alloying Elements—Li and W; Fundamental Micro-alloying RE Element—Nd; High-Efficiency Modification Element—C (1) Weigh the required alloying elements according to the following formula calculation table.

| | Element | | | | | | | | | |
|---|---|---|---|---|---|---|---|---|---|---|
| | Al | Cu | Mn | Cd | Zr | Li | W | Ti | Nd | B + C |
| Mass (g) | 10855.5 | 840 | 60 | 48 | 100 | 12 | 12 | 60 | 12 | 0.5 |
| Total | 12000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Li, Al—W and Al—Zr (including salt compounds) in the proportions indicated in the formula, agitate to homogeneous state; then add pure metal of Cu and intermediate alloy or mixed metal additive of Al—Cd; next add B, C, and RE element Er, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Li, W, B, C, or Ti with flux. The flux refers to a mixture of alkali metal haloids or alkali-earth metal haloids, including NaCl, KCl, and $Na_3AlF_6$. C refers to a compound or Al—C intermediate alloy, including binary intermediate alloys, ternary intermediate alloys, and multi-element intermediate alloys.

(4) Refine the above-mentioned melt of alloy in the furnace; add a refining agent (chlorine, hexachloroethane, or manganese chloride etc. as refining agent, depending on the actual circumstance) into the melt of alloy, and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 517 MPa, elongation: 5.2%.

Example 61

Cu-8%; Characteristic Micro-alloying Elements—Li and W; Fundamental Micro-alloying RE Element—Ce; High-Efficiency Modification Element—C (1) Weigh the required alloying elements according to the following formula calculation table.

| | Element | | | | | | | | | |
|---|---|---|---|---|---|---|---|---|---|---|
| | Al | Cu | Mn | Cd | Zr | Li | W | Ti | Ce | B + C |
| Mass (g) | 10681 | 960 | 72 | 60 | 96 | 15 | 15 | 60 | 36 | 5 |
| Total | 12000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Li, Al—W and Al—Zr (including salt compounds) in the proportions indicated in the formula, agitate to homogeneous state; then add pure metal of Cu and intermediate alloy or mixed metal additive of Al—Cd; next add B, C, and RE element Er, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Li, W, B, C, or Ti with flux. The flux refers to a mixture of alkali metal haloids or alkali-earth metal haloids, including NaCl, KCl, and $Na_3AlF_6$. C refers to a compound or intermediate alloy of Al—C, including binary intermediate alloys, ternary intermediate alloys, and multi-element intermediate alloys.

(4) Refine the above-mentioned melt of alloy in the furnace; add a refining agent (chlorine, hexachloroethane, or manganese chloride etc. as refining agent, depending on the actual circumstance) into the melt of alloy, and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 501 MPa, elongation: 4.8%.

Example 62

Cu-10%; Characteristic Micro-alloying Elements—Li and W; Fundamental Micro-alloying RE Element—Y; High-Efficiency Modification Element—C (1) Weigh the required alloying elements according to the following formula calculation table.

| | Element | | | | | | | | | |
|---|---|---|---|---|---|---|---|---|---|---|
| | Al | Cu | Mn | Cd | Zr | Li | W | Ti | Y | B + C |
| Mass (g) | 10485 | 1200 | 60 | 48 | 72 | 18 | 18 | 60 | 24 | 15 |
| Total | 12000 (g) | | | | | | | | | |

(2) Add aluminum ingots in appropriate amount to the smelting furnace, heat it up to melt completely, and keep the temperature at 700~800° C.; the melting process should be accomplished in an enclosed environment within a period duration as short as possible, to prevent excessive air entrainment into the melt.

(3) Add intermediate alloys or mixed metal additives of Al—Mn, Al—Ti, Al—Li, Al—W and Al—Zr (including salt compounds) in the proportions indicated in the formula, agitate to homogeneous state; then add pure metal of Cu and intermediate alloy or mixed metal additive of Al—Cd; next add B, C, and RE element Er, and agitate to homogeneous state.

Wherein, the mixed metal additive refers to a cake-shaped or lump-shaped non-sintered powder metallurgy product for adding or adjusting the constituent elements of the alloy, is prepared by mixing the metal powder of Mn, Cu, Zr, Li, W, B, C, or Ti with flux. The flux refers to a mixture of alkali metal haloids or alkali-earth metal haloids, including NaCl, KCl, and $Na_3AlF_6$. C refers to a compound or intermediate alloy of Al—C, including binary intermediate alloys, ternary intermediate alloys, and multi-element intermediate alloys.

(4) Refine the above-mentioned melt of alloy in the furnace; add a refining agent (chlorine, hexachloroethane, or manganese chloride etc. as refining agent, depending on the actual circumstance) into the melt of alloy, and agitate to homogeneous state; the refining of the melt should be accomplished in an enclosed environment as far as possible, to prevent the melt from absorbing moisture and burning loss.

(5) Shatter the slag, stand, and adjust the temperature to 630~850° C. after refining, and then pour out the alloy liquid from the furnace, degas and remove slag on line.

(6) Cast (crystal solidification in the mold).

(7) Perform solution treatment to the cast product at a temperature of 470~560° C. for a period duration of 30 h or less.

(8) Indexes of test sample: tensile strength: 487 MPa, elongation: 4.3%.

What is claimed is:

1. A multi-element strengthened and modified heat-resistant aluminum alloy material with high strength, consisting of the following components by weight: Cu: 1.0-10.0%, Mn: 0.05-1.5%, Cd: 0.01-0.5%, Ti: 0.01-0.5%, Zr: 0.01-1.0%, characteristic metallic element R: 0.001-3%, rare earth element Re: 0.05-5%, one of B: 0.01-0.2%, C: 0.0001-0.15% or a combination thereof, and Al: the rest, the characteristic metallic element is one selected from the group consisting of Be, Co, Cr, Li, Mo, Nb, Ni, and W, or the characteristic metallic element is a combination of any two elements selected from the group consisting of Be, Co, Cr, Li, Mo, Nb, Ni, and W.

2. The multi-element strengthened and modified heat-resistant aluminum alloy material with high strength according to claim 1, characterized in that the rare earth element RE is one rare earth element selected from the group consisting of La, Ce, Pr, Nd, Er, Y, and Sc or the rare earth element RE is a mixture of two or more rare earth elements selected from the group consisting of La, Ce, Pr, Nd, Er, Y, and Sc.

* * * * *